US011696621B2

(12) United States Patent
Smith

(10) Patent No.: US 11,696,621 B2
(45) Date of Patent: Jul. 11, 2023

(54) SHOELACE RETAINERS FOR SHOES, AND RELATED METHODS

(71) Applicant: Jeremy Smith, Boulder, CO (US)

(72) Inventor: Jeremy Smith, Boulder, CO (US)

( * ) Notice: Subject to any disclaimer, the term of this patent is extended or adjusted under 35 U.S.C. 154(b) by 0 days.

(21) Appl. No.: 17/010,404

(22) Filed: Sep. 2, 2020

(65) Prior Publication Data

US 2021/0085032 A1 Mar. 25, 2021

Related U.S. Application Data

(63) Continuation-in-part of application No. 16/174,928, filed on Oct. 30, 2018, now Pat. No. 10,820,660.

(60) Provisional application No. 62/895,100, filed on Sep. 3, 2019, provisional application No. 62/579,747, filed on Oct. 31, 2017.

(51) Int. Cl.
*A43C 11/00* (2006.01)
*A43C 11/14* (2006.01)

(52) U.S. Cl.
CPC ..... *A43C 11/14* (2013.01)

(58) Field of Classification Search
CPC ..... Y10T 24/3703; Y10T 24/3713; Y10T 24/3716; Y10T 24/3705; Y10T 24/3708; Y10T 24/3718; A43C 7/005; A43C 7/00; A43C 7/04; A43C 7/02; A44C 11/14
See application file for complete search history.

(56) References Cited

U.S. PATENT DOCUMENTS

| | | | | |
|---|---|---|---|---|
| 2,841,849 | A | 7/1958 | Rice | |
| 3,122,805 | A | 3/1964 | Hakim | |
| 5,746,500 | A | 5/1998 | Chien | |
| 8,888,346 | B2 | 11/2014 | Tseng | |
| 10,820,660 | B2 | 11/2020 | Smith | |
| 2004/0221433 | A1* | 11/2004 | Wolfberg | A43B 23/24 24/712.5 |
| 2016/0081432 | A1 | 3/2016 | Caron | |
| 2019/0125033 | A1 | 5/2019 | Smith | |

* cited by examiner

*Primary Examiner* — Jack W Lavinder
(74) *Attorney, Agent, or Firm* — Harness, Dickey & Pierce, P.L.C.

(57) ABSTRACT

A shoelace retainer is provided for use with a shoe. The shoelace retainer generally includes a base defining at least one channel for receiving a first portion of a shoelace therein while the shoelace is coupled to a shoe, thereby coupling the shoelace retainer to the shoe, and a cap associated with the base and defining at least one receptacle relative to the base where the at least one receptacle is configured to receive a second portion of the shoelace when the base is coupled to the shoe.

14 Claims, 34 Drawing Sheets

SHOELACE RETAINERS FOR SHOES, AND RELATED METHODS

CROSS-REFERENCE TO RELATED APPLICATIONS

This application claims the benefit of, and priority to, U.S. Provisional Application No. 62/895,100, filed Sep. 3, 2019. This application is also a continuation-in-part of U.S. patent application Ser. No. 16/174,928, filed Oct. 30, 2018, which claims the benefit of, and priority to, U.S. Provisional Application No. 62/579,747, filed Oct. 31, 2017. The disclosure of each of these applications is incorporated herein by reference in its entirety.

FIELD

The present disclosure generally relates to shoelace retainers for shoes, and methods relating thereto.

BACKGROUND

This section provides background information related to the present disclosure which is not necessarily prior art.

Shoelaces are often used to secure shoes to feet of individuals. In connection therewith, the shoelaces are initially threaded through eyelets of the shoes. Then, the shoes are positioned on the feet of the individuals and the shoelaces are tied to secure the shoes to the individuals' feet. Typically, the shoelaces are tied in bow knots in which free ends of the shoelaces are folded or formed into loops and allowed to hang loose over the shoes.

SUMMARY

This section provides a general summary of the disclosure, and is not a comprehensive disclosure of its full scope or all of its features.

Example embodiments of the present disclosure generally relate to shoelace retainers for use with shoelaces coupled to shoes.

In one example embodiment, a shoelace retainer generally includes a base defining a channel for receiving a shoelace of a shoe therein to thereby couple the shoelace retainer to the shoe; a body disposed generally above the base and defining first and second channels for receiving portions of the shoelace therein, while the shoelace is coupled to the shoe; and a mount disposed on the body and at least partly defining the first and second channels.

In another example embodiment, a shoelace retainer generally includes a base defining at least one channel for receiving a shoelace of the a therein, to thereby couple the shoelace retainer to the shoe when the shoelace is coupled to the shoe; and a body coupled to the base and defining at least one channel for receiving an end portion of the shoelace therein, while the shoelace retainer is coupled to the shoe.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
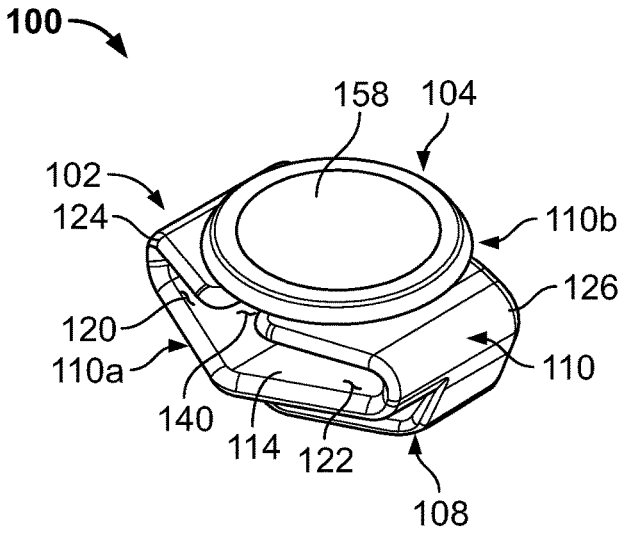
FIG. 1 is a perspective view of an example embodiment of a shoelace retainer including one or more aspects of the present disclosure.
Figure 2:
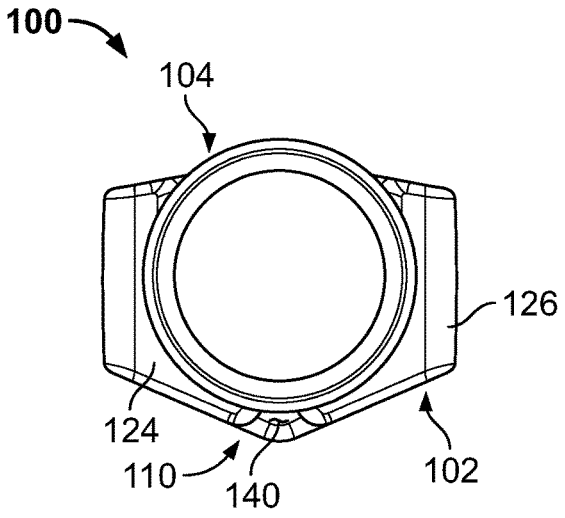
FIG. 2 is a top plan view of the shoelace retainer of FIG. 1.
Figure 3:
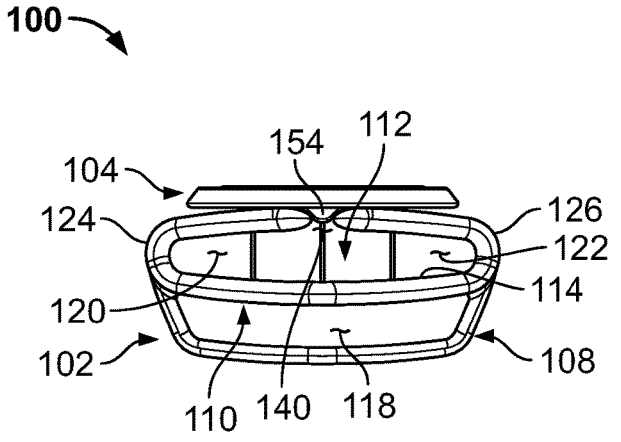
FIG. 3 is a front elevation view of the shoelace retainer of FIG. 1.
Figure 4:
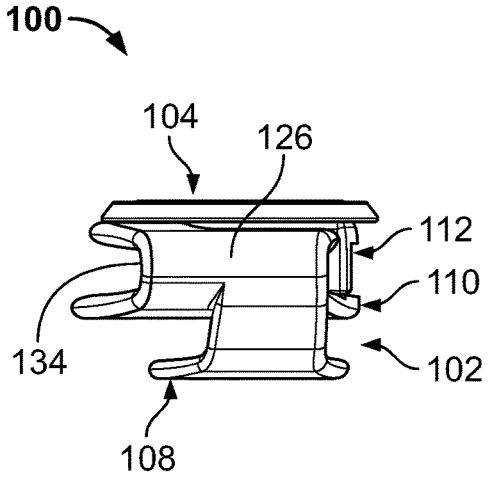
FIG. 4 is a side elevation view of the shoelace retainer of FIG. 1.

Example embodiments will now be described more fully with reference to the accompanying drawings. The description and specific examples included herein are intended for purposes of illustration only and are not intended to limit the scope of the present disclosure.

FIGS. 1-25 illustrate an example embodiment of a shoelace retainer 100 for use with a shoe and including one or more aspects of the present disclosure. The shoelace retainer 100 is configured (e.g., sized, shaped, constructed, etc.) to couple to a shoelace of a shoe (i.e., to a shoelace coupled to a shoe) and then retain portions of the shoelace in the retainer 100 (e.g., free end portions of the shoelace where the free end portions of the shoelace are threaded to the shoe via eyelets of the shoe and then tied together to secure the shoe on a user's foot, etc.). As such, when coupled to the shoe, the shoelace retainer 100 may help inhibit the shoelace from untying (e.g., help inhibit a knot formed by the free ends of the shoelace from coming undone, etc.) and/or help inhibit the shoelace from dragging on the ground, etc. This will be described in more detail hereinafter.

As shown in FIGS. 1-5, the illustrated shoelace retainer 100 generally includes a support 102, and a cap 104 configured to removeably couple to the support 102. The support 102 includes a base 108, a body 110, and a mount 112. The body 110 is disposed generally over (and/or above) the base 108 (as viewed in the figures). And, the mount 112 is disposed on the body 110 and extends generally upward from a floor 114 of the body 110. In the illustrated embodiment, the base 108, the body 110, and the mount 112 are integral in construction (e.g., the base 108, the body 110, and the mount 112 are monolithically formed as one piece, etc.). In other embodiments, though, the base 108, the body 110, and/or the mount 112 of the support 102 may be formed separately from the other parts of the support 102 and connected thereto (e.g., by way of welds, glue, fasteners, etc.).

With additional reference to FIGS. 6-13, the base 108 of the shoelace retainer 100 includes (or defines) a channel 118 (broadly, an opening) extending through the base 108. As will be described in more detail hereinafter, the channel 118 is configured to receive portions of a shoelace therethrough for coupling the shoelace retainer 100 to a shoe (broadly, the base 108 of the body 110 defines means (e.g., the channel 118 defined through the base 108, etc.) for coupling the shoelace retainer 100 to the shoe via a shoelace already at least partly coupled to the shoe). While, in the illustrated embodiment, the base 108 includes the one channel 118, it should be appreciated that in other embodiments the base 108 may include more than one channel (e.g., two channels, etc.).

The body 110 of the shoelace retainer 100 includes (or defines) first and second channels 120, 122 extending through the body 110 (generally, from a forward portion 110*a* of the body 110 to a rearward portion 110*b* of the body 110 (FIG. 1)), and around the mount 112 (such that the mount 112 may be viewed as defining at least part of the first and second channels 120, 122 together with the body 110). In this configuration, the first and second channels 120, 122 are located generally over the channel 118. Arms 124, 126 of the body 110, located toward side portions of the body 110, extend generally upward from the floor 114 of the body 110 and over (e.g., at least partly over, etc.) a portion of the channels 120, 122 (such that the arms 124, 126 of the body 110 may also be viewed as defining a portion of the channels 120, 122). In particular, the first arm 124 extends generally over a portion of the first channel 120 and the second arm 126 extends generally over a portion of the second channel 122. The first and second channels 120, 122 are generally separated from each other at the rearward portion 110*b* of the body 110 (by the mount 112), and generally merge together toward the forward portion 110*a* of the body 110 (forward of the mount 112). In this way, two openings 130, 132 are defined in the reward portion 110*b* of the body 110 (FIG. 8), each leading to a respective one of the channels 120, 122, and a single opening 134 is defined in the forward portion 110*a* of the body 110 (FIG. 4) providing access to both of the channels 120, 122. By this construction, the first and second channels 120, 122 may be viewed as having generally angular shapes (e.g., where the channels 120, 122 generally curve around the mount 112, etc.).

Slots 136, 138 are then defined between the respective arms 124, 126 of the body 110 and the mount 112 (FIGS. 5-8), and generally provide an opening extending into the respective first and second channels 120, 122 of the body 110. And, a spacing 140 is formed between free end portions 124*a*, 126*a* of the arms 124, 126 (generally toward the forward portion of the body 110). The free end portions 124*a*, 126*a* of the arms 124, 126 extend generally across the floor 114 of the body 110 at a location forward of the mount 112. As such, they provide for additional coverage over the channels 120, 122 at this location (i.e., the free end portions 124*a*, 126*a* of the arms 124, 126 cover more of the channels 120, 122 than rearward portions 124*b*, 126*b* of the arms 124, 126). Further, this configuration of the arms 124, 126 forms an angled portion in each of the slots 136, 138 on opposite sides of the mount 112, as the slots 136, 138 extend toward the spacing 140 defined between the free end portions 124*a*, 126*a* of the arms 124, 126. In this fashion, the body 110 generally defines improved means (e.g., the channels 120, 122 extending through the body 110, the arms 124, 126 extending over the channels 120, 122, the angled portions of the slots 136, 138, etc.) for securing portions of the shoelace (e.g., end portions of the shoelace, etc.), when tied, in the shoelace retainer 100 (and on the shoe, when the shoelace retainer 100 is also coupled to the shoe). In the illustrated embodiment, the body 110 includes the two arms 124, 126 located on generally opposite sides of the body 110 (and on generally opposite sides of the mount 112). In other embodiments, though, the body 110 may include a single arm, or it may include more than the two arms 124, 126 (e.g., three arms, four arms, etc.), for example, extending away from the body 110 and over at least part of the first and/or second channels 120, 122 in a similar manner to the arms 124, 126.

With reference now to FIGS. 1-5 and 14-16, the cap 104 of the shoelace retainer 100 is configured to couple to the body 110 at the mount 112 (broadly, to the support 102), in a positon such that the cap 104 is located generally over (or above) the body 110. In particular, the cap 104 includes a boss 144, extending away from a lower surface of the cap 104, configured to snap-fit within an opening 146 of the mount 112. And, when the boss 144 is positioned in the opening 146, a lip 148 of the boss 144 is configured to position generally under tabs 150 of the mount 112 (located within the opening 146). In this way, the tabs 150 of the mount 112 and the lip 148 of the boss 144 operate to retain the boss 144 in the opening 146 (and the cap 104 coupled to the mount 112), but allow for rotational movement of the cap 104 relative to the mount 112. This also allows the cap 104 to be removed from the mount 112 when desired (by selectively disengaging the lip 148 of the boss 144 from under the tabs 150 and removing the boss 144 from the opening of the mount 112). With that said, it should be appreciated that in other embodiments of the present disclosure, the cap 104 of the shoelace retainer 100 may couple to the mount 112 in other manners (e.g., by way of keyed couplings, etc.). It should also be appreciated that in other embodiments, the cap 104 may be integral with the support 102 (e.g., where the mount 112 and the cap 104 are formed together as one piece, etc.), but still be moveable relative to the mount 112 and body 110 as described herein.

Also in this embodiment, the boss 144 is disposed on the cap 104 at a location away from a center point 104*a* of the cap 104 (e.g., the boss 144 is positioned off-center on the cap 104, etc.) (see, FIGS. 15 and 16). As such, when the cap 104 is coupled to the mount 112, the cap 104 is configured to rotate or pivot (at the boss 144) relative to the mount 112 and the body 110 in a generally arcuate (or curved) motion (e.g., an off-center rotation, etc.). While in the illustrated embodiment the cap 104 is generally circular in shape, it should be appreciated that the cap may have other shapes within the scope of the present disclosure (e.g., oval, square, triangular, etc.)

Figure 22:
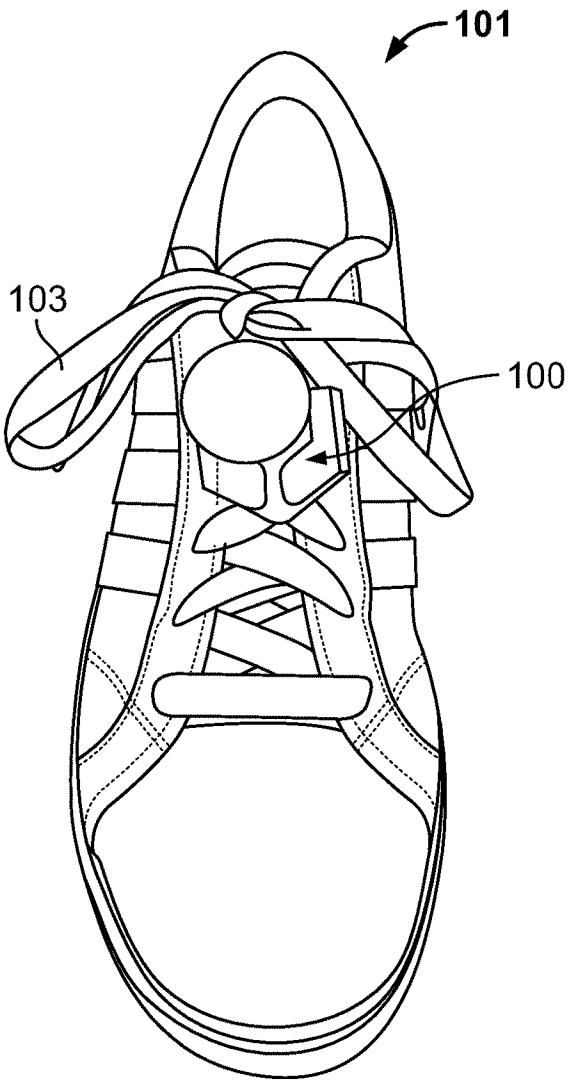
Figure 24:
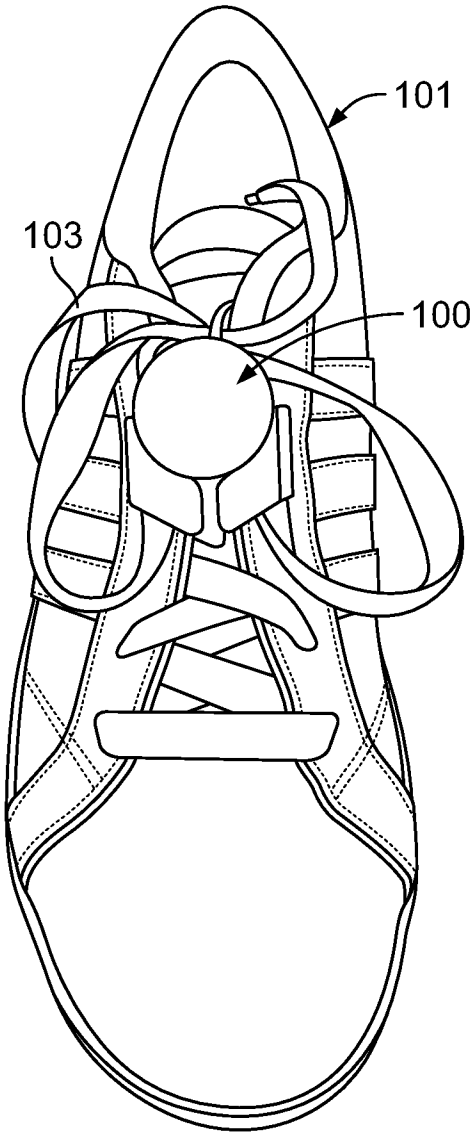
Figure 23:
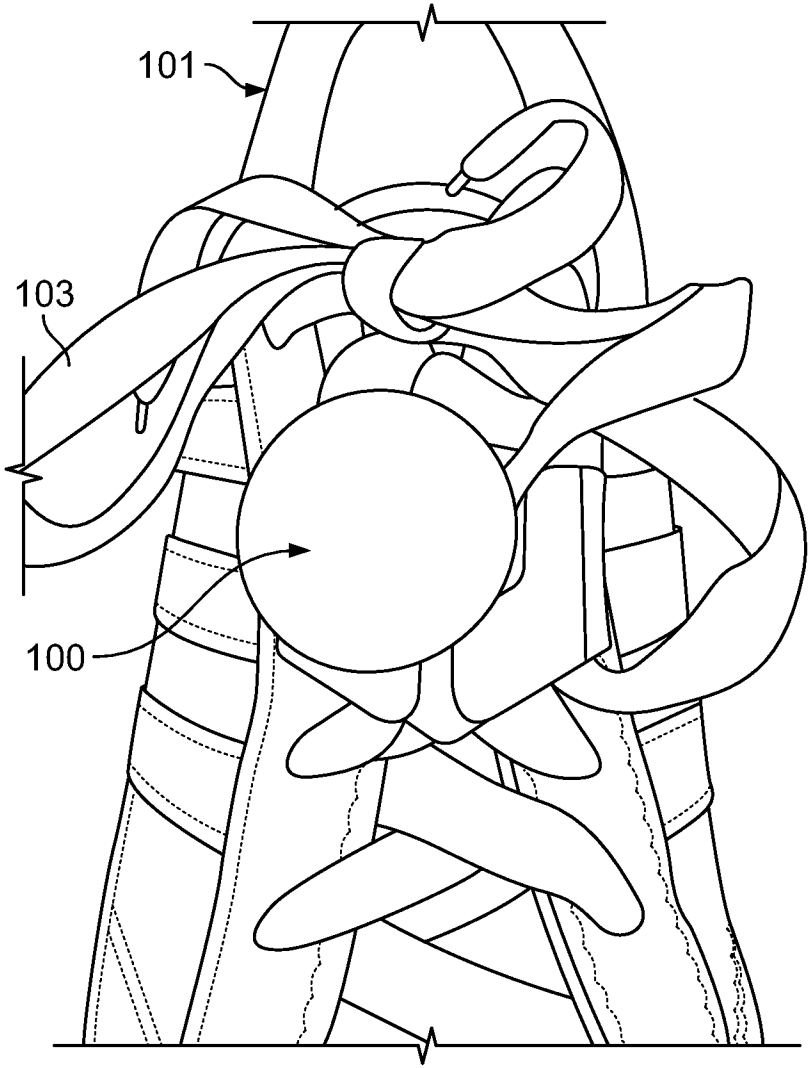
Figure 25:
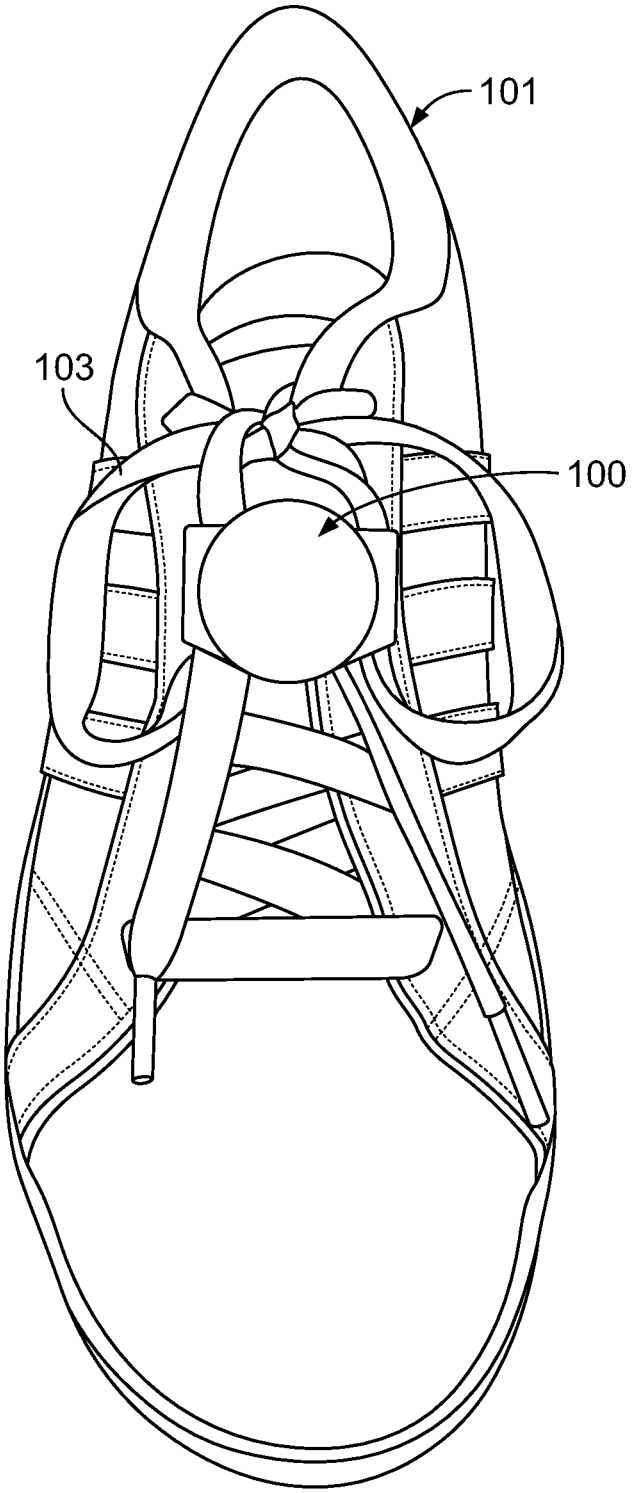
Figure 26:
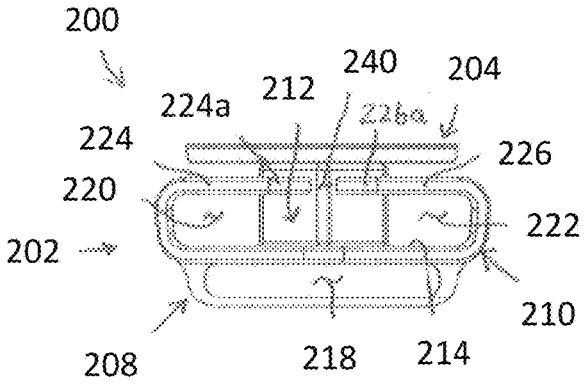
FIG. 26 is a front elevation view of another example embodiment of a shoelace retainer including one or more aspects of the present disclosure.
Figure 27:
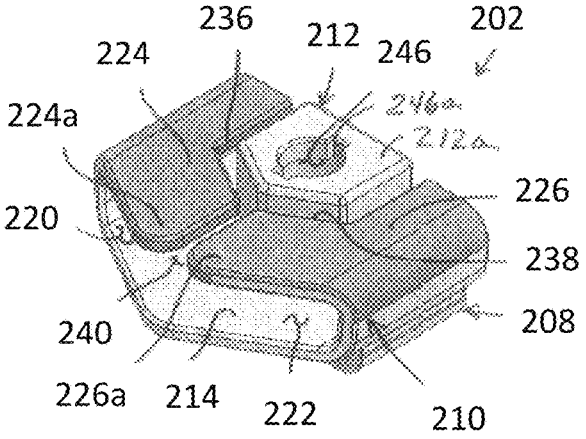
FIG. 27 is a perspective view of a support of the shoelace retainer of FIG. 26.
Figure 28:
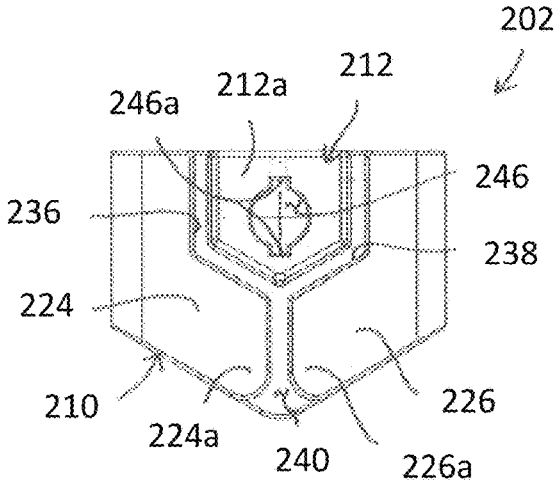
FIG. 28 is a top plan view of the support of FIG. 27.
Figure 29:
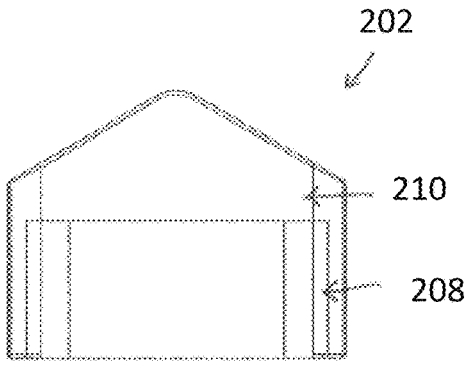
FIG. 29 is a bottom plan view of the support of FIG. 27.
Figure 30:
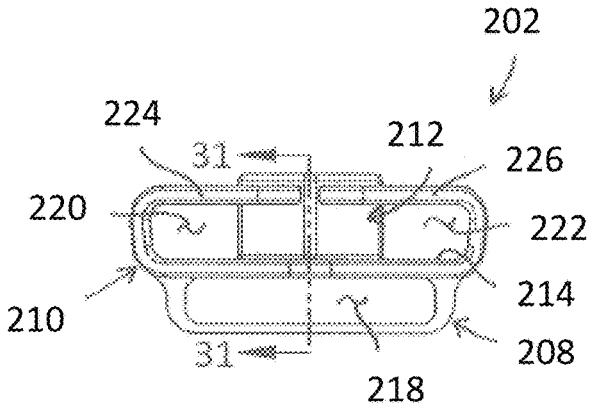
FIG. 30 is a front elevation view of the support of FIG. 27.
Figure 31:
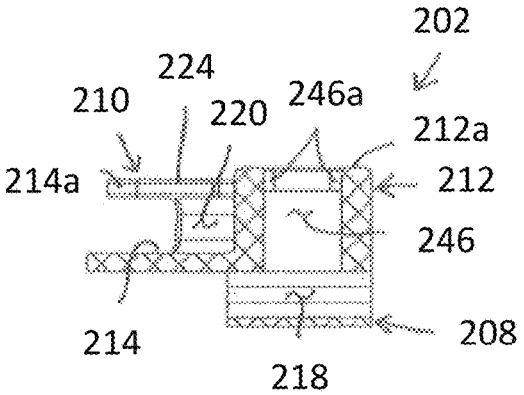
FIG. 31 is a section view of the support taken in a plane including line 31-31 in FIG. 30.
Figure 32:
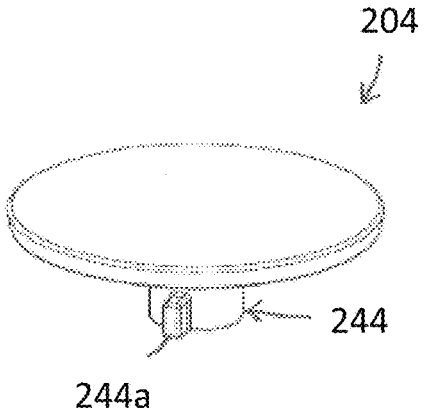
FIG. 32 is a perspective view of a cap of the shoelace retainer of FIG. 26.
Figure 33:
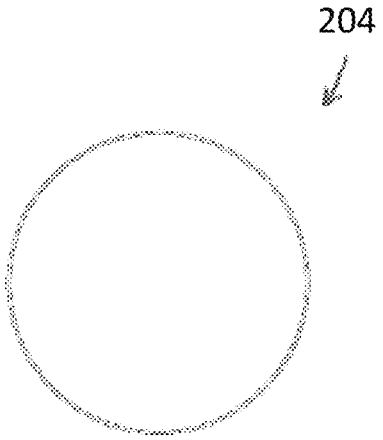
FIG. 33 is a top plan view of the cap of FIG. 32.
Figure 34:
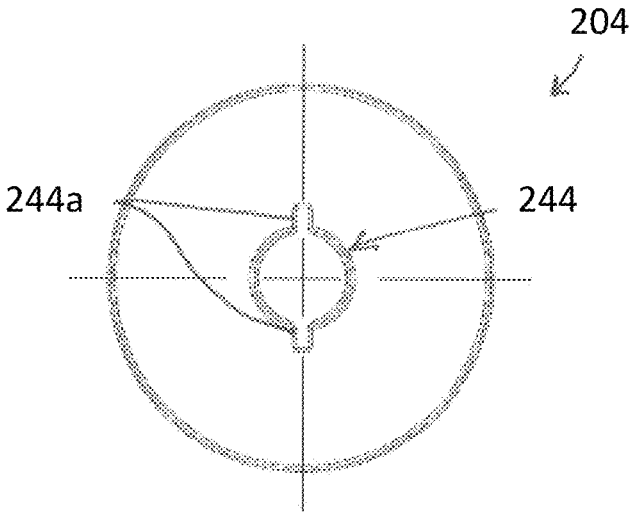
FIG. 34 is a bottom plan view of the cap of FIG. 32.
Figure 35:
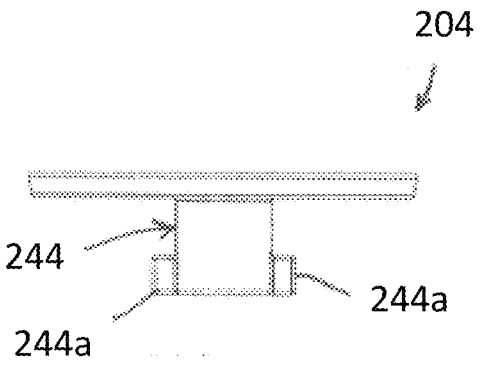
FIG. 35 is a side elevation view of the cap of FIG. 32.
Figure 36:
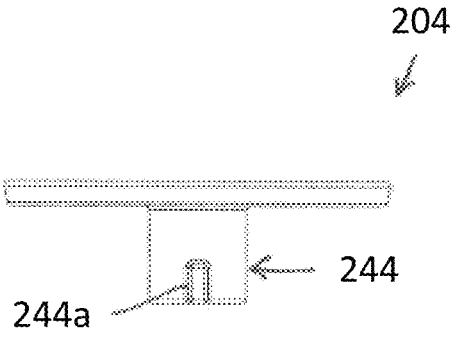
FIG. 36 is a front elevation view of the cap of FIG. 32.
Figure 37:
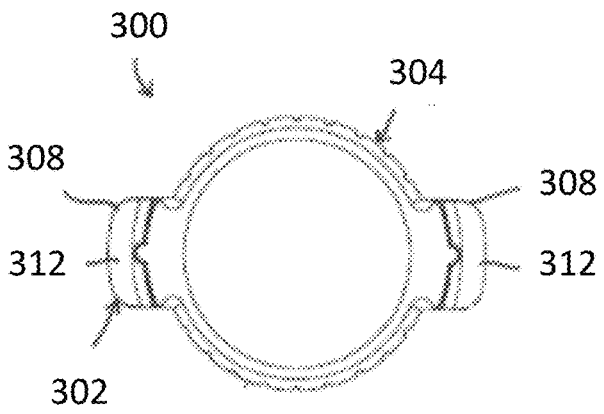
FIG. 37 is a top plan view of another example embodiment of a shoelace retainer including one or more aspects of the present disclosure.
Figure 38:
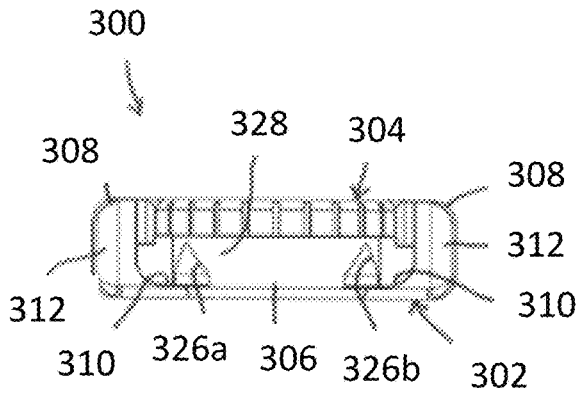
FIG. 38 is a front elevation view of the shoelace retainer of FIG. 37.
Figure 39:
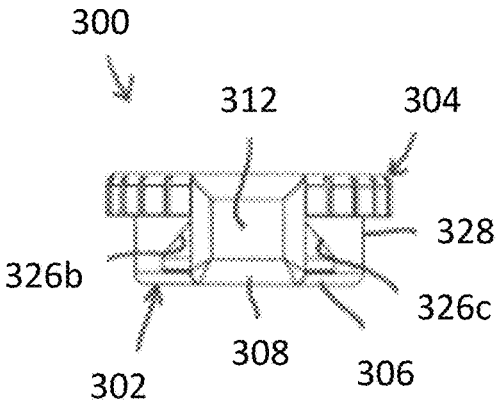
FIG. 39 is a side elevation view of the shoelace retainer of FIG. 37.
Figure 40:
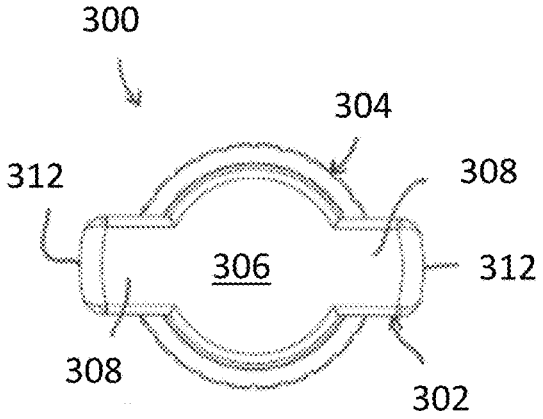
FIG. 40 is a bottom plan of the shoelace retainer of FIG. 37.
Figure 41:
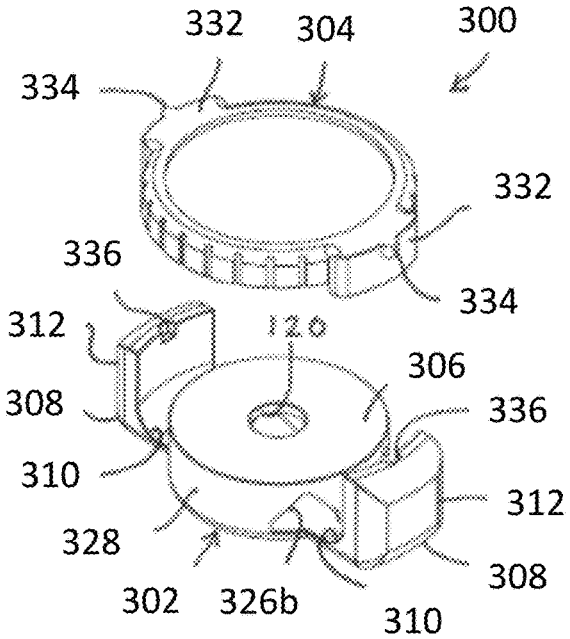
FIG. 41 is an exploded perspective view of the shoelace retainer of FIG. 37.
Figure 42:
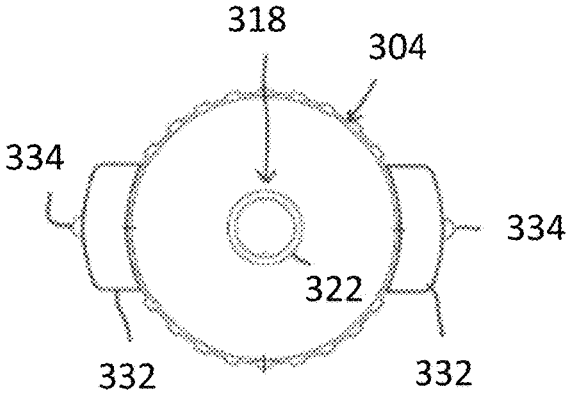
FIG. 42 is a bottom plan view of a cap of the shoelace retainer of FIG. 37.
Figure 43:
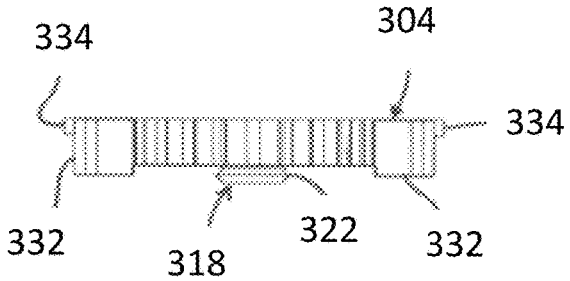
FIG. 43 is a front elevation view of the cap of FIG. 42.
Figure 44:
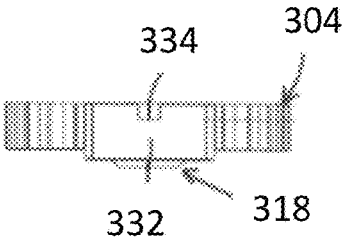
FIG. 44 is a side elevation view of the cap of FIG. 42.
Figure 45:
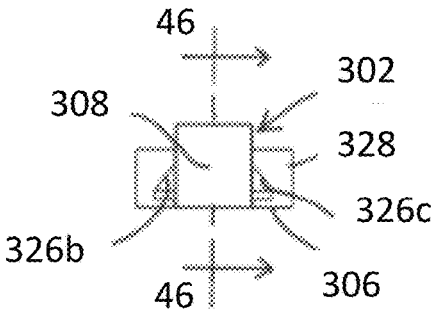
FIG. 45 is a side elevation view of a base of the shoelace retainer of FIG. 37.
Figure 46:
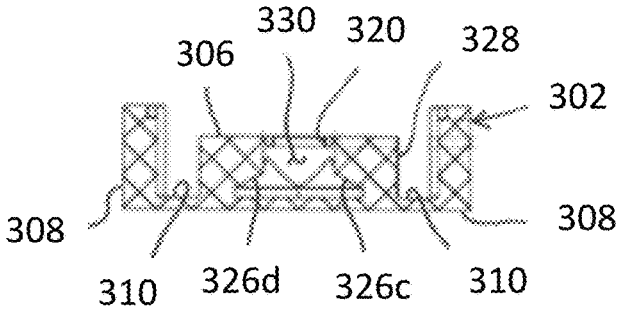
FIG. 46 is a section view of the base taken in a plane including line 46-46 in FIG. 45.

That said, in a closed position of the shoelace retainer 100 (broadly, a first position), the cap 104 is located generally over the arms 124, 126 of the body 110, and over the slots 136, 138 defined between the arms 124, 126 and the mount 112 and over the spacing 140 defined between the free end portions 124*a*, 126*a* of the arms 124, 126 (FIGS. 1-4). Here, a protrusion 154 of the cap 104 is configured to position (or fit) within the spacing 140 defined between the free end portions 124*a*, 126*a* of the arms 124, 126 to help hold, secure, retain, etc. the cap 104 (and, broadly, the shoelace retainer 100) in the closed position (and to help inhibit undesired or unwanted movement of the cap 104 relative to the mount 112 and the base 108 (e.g., to help inhibit and/or resist undesired or unwanted movement of the shoelace retainer 100 to an open position, etc.)). And, in the open position of the shoelace retainer 100 (broadly, a second position), the protrusion 154 of the cap 104 is moved out of (or disengaged from) the spacing 140 defined between the end portions 124*a*, 126*a* of the arms 124, 126 (e.g., by away of rotating the cap 104, etc.), and the cap 104 is located generally away from the arms 124, 126 of the body 110 (or away from at least one of the arms 124, 126 of the body 110) (e.g., the cap 104 is rotated in an off-center or arcuate movement about ninety degrees, about one-hundred eighty degrees, greater than one-hundred eighty degrees, less than ninety degrees, amounts there between, etc. to expose at least one of the slots 136, 138; etc.) (FIGS. 22-24). In connection therewith, in moving the cap 104 from the closed position to the open position, the spacing 140 defined between the end portions 124*a*, 126*a* of the arms 124, 126 and the slots 136, 138 defined between the arms 124, 126 and the mount 112 (specifically, at least one of the slots 136, 138) are uncovered.

Then, and as will be described in more detail next, when the shoelace retainer 100 is coupled to a shoe and is in the open position, end portions of a shoelace (e.g., where the shoelace is already threaded at least partly to a shoe, etc.) may be positioned in the shoelace retainer 100, in the first and/or second channels 120, 122 generally under the arms 124, 126, by way of the slots 136, 138 and the spacing 140 between the free end portions 124*a*, 126*a* of the arms 124, 126 (e.g., the free end portions of the shoelace including bow portions, etc.). The shoelace retainer 100 may then be moved to the closed position (by rotating the cap 104), whereby the cap 104 moves into a position generally over the slots 136, 138 and over the spacing 140 between the free end portions 124*a*, 126*a* of the arms 124, 126 to secure the end portions of the shoelace in the shoelace retainer 100 (whereby the arms 124, 126 and/or the cap 104 operate to help retain the end portions of the shoelace in the shoelace retainer 100).

Figure 5:
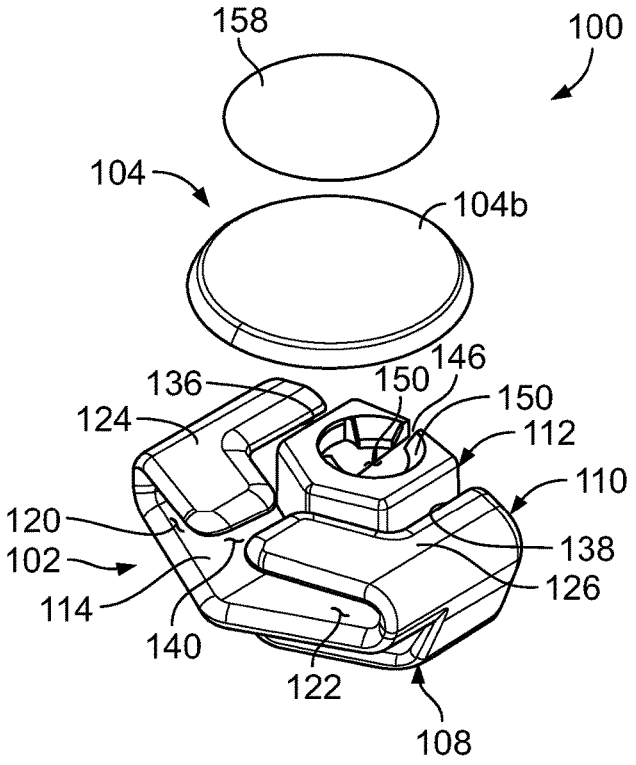
FIG. 5 is an exploded perspective view of the shoelace retainer of FIG. 1.
Figure 6:
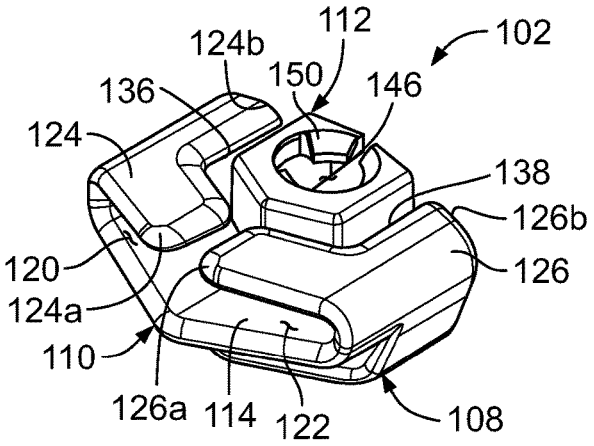
FIG. 6 is a perspective view of a support of the shoelace retainer of FIG. 1.
Figure 7:
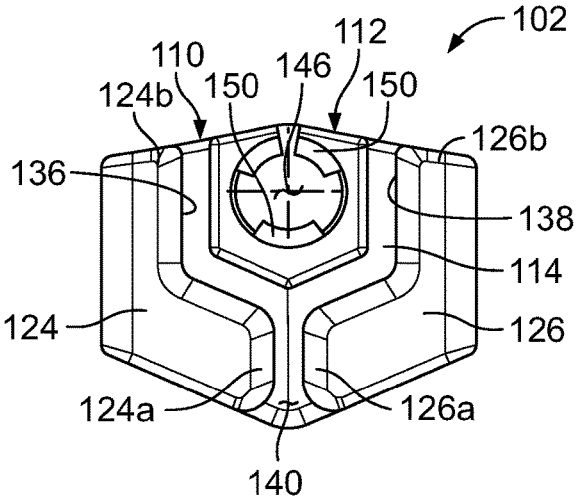
FIG. 7 is a top plan view of the support of FIG. 6.
Figure 8:
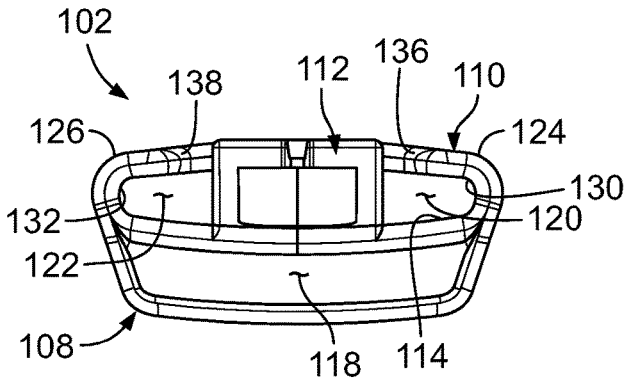
FIG. 8 is a rear elevation view of the support of FIG. 6.
Figure 9:
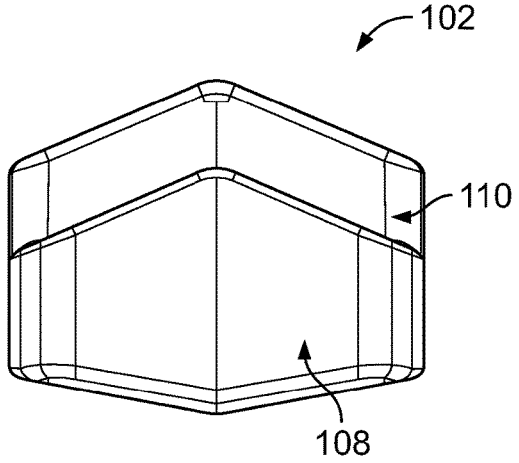
FIG. 9 is a bottom plan view of the support of FIG. 6.
Figure 10:
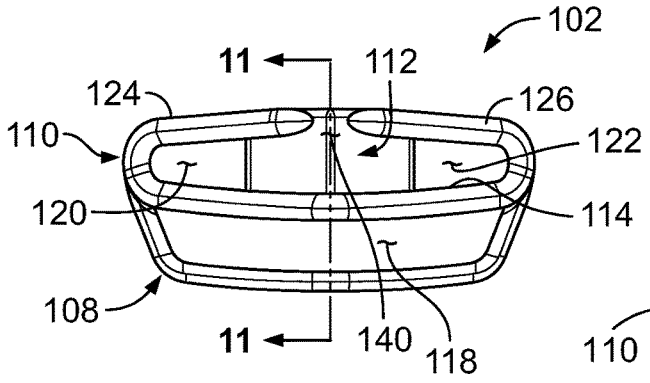
FIG. 10 is a front elevation view of the support of FIG. 6.
Figure 11:
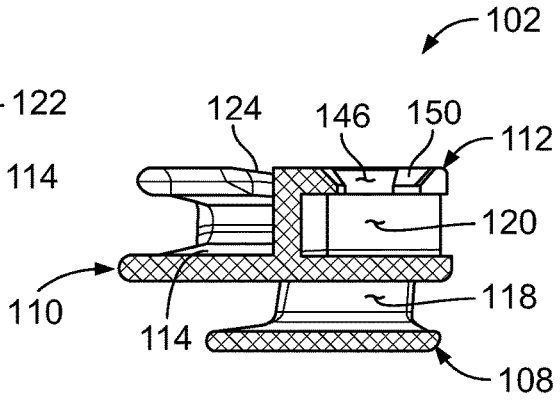
FIG. 11 is a section view of the support taken in a plane including line 11-11 in FIG. 10.
Figure 12:
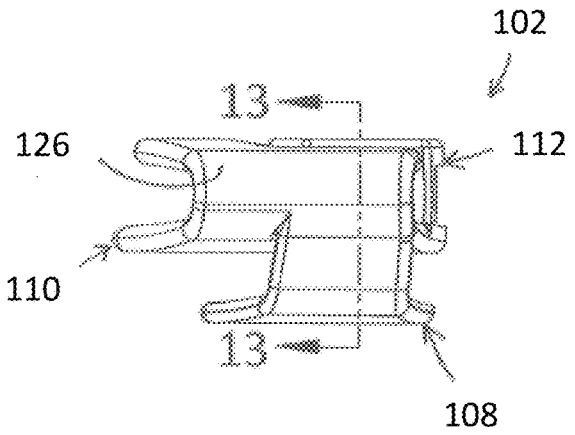
FIG. 12 is a side elevation view of the support of FIG. 6.
Figure 13:
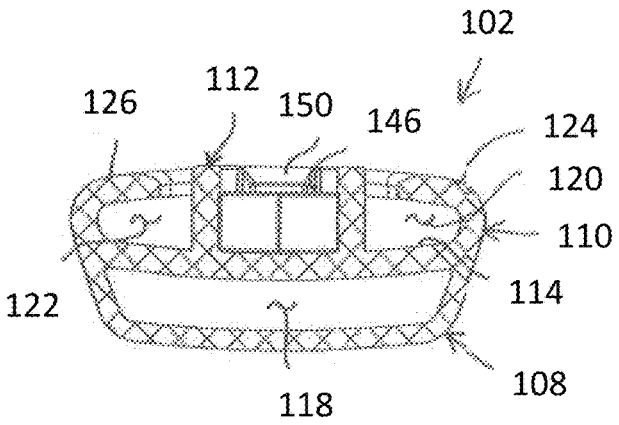
FIG. 13 is a section view of the support taken in a plane including line 13-13 in FIG. 12.
Figure 14:
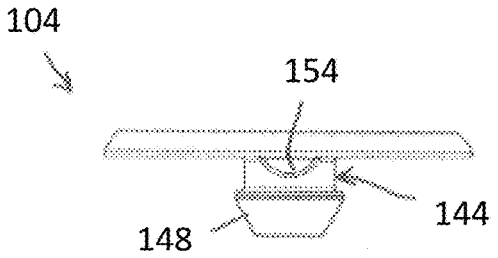
FIG. 14 is a front elevation view of a cap of the shoelace retainer of FIG. 1.
Figure 15:
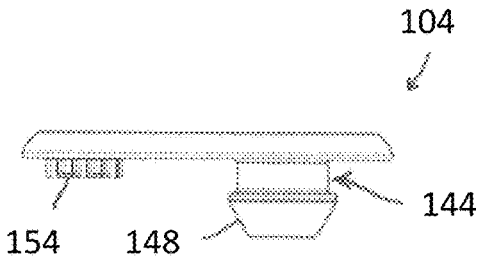
FIG. 15 is a side elevation view of the cap of FIG. 14.
Figure 16:
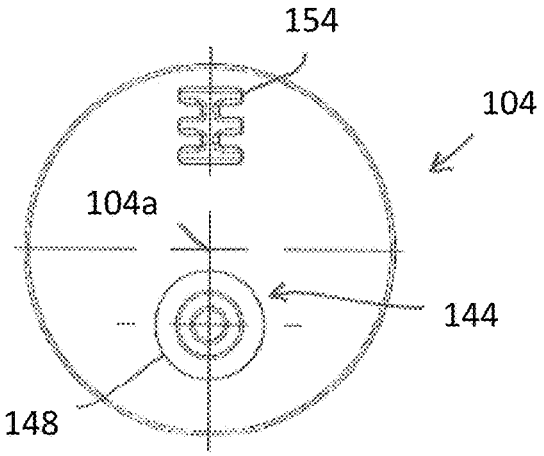
FIG. 16 is a bottom plan view of the cap of FIG. 14.
Figure 17:
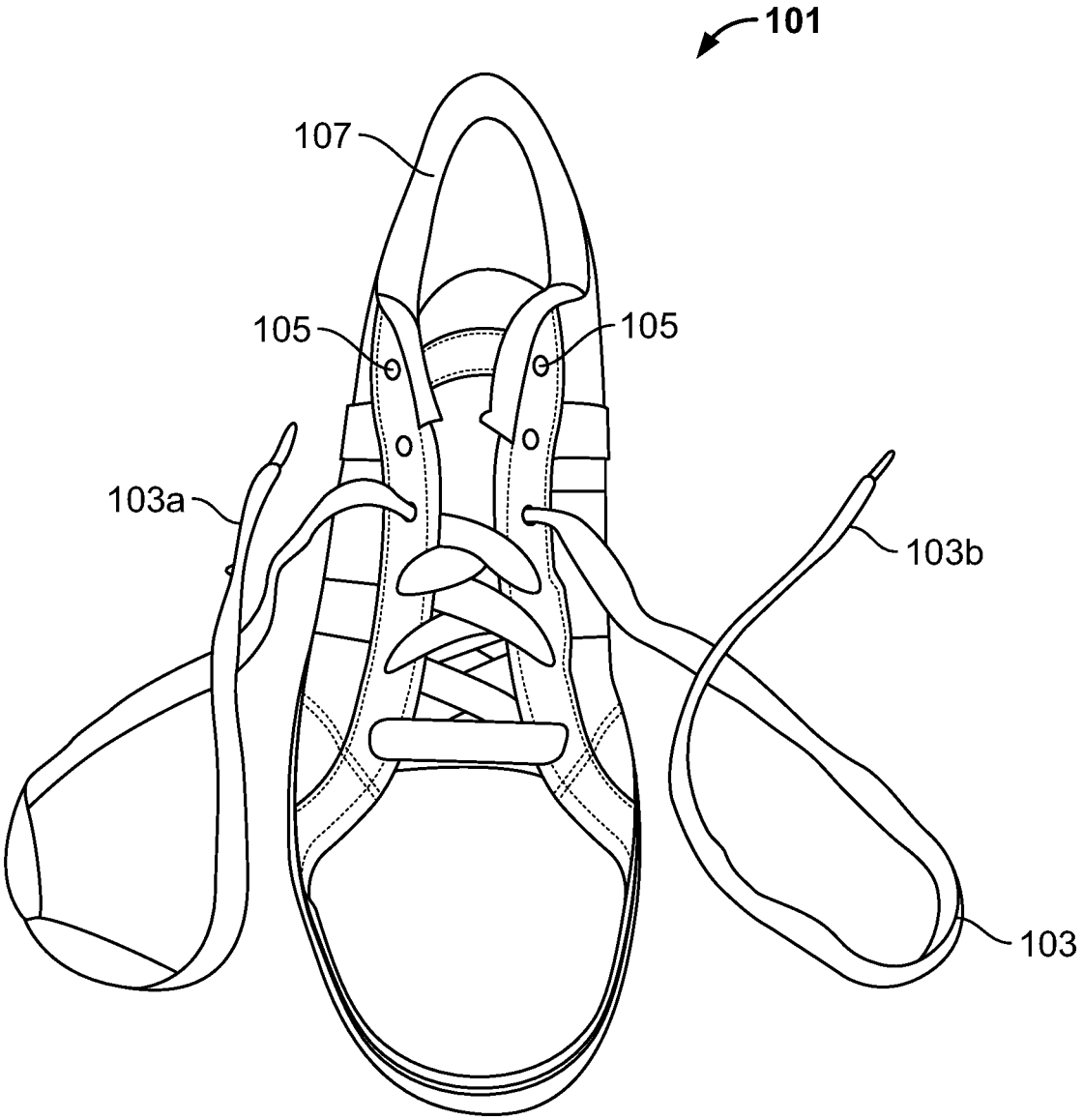
FIGS. 17-25 illustrate an example operation of installing the shoelace retainer of FIGS. 1-16 to a shoe.

Also in this embodiment, and with reference to FIGS. 1 and 5, the shoelace retainer 100 includes a decal 158 coupled to an upper portion 104*b* of the cap 104. The decal 158 may be coupled to the cap 104 by way of any suitable fasteners (e.g., glue, mechanical fasteners such as clips, etc.). In other embodiments, the decal 158 may be formed integral with the cap 104. That said, the decal 158 may include any desired shapes, sizes, images, colors, textures, etc. for display on the shoelace retainer 100.

Figure 19:
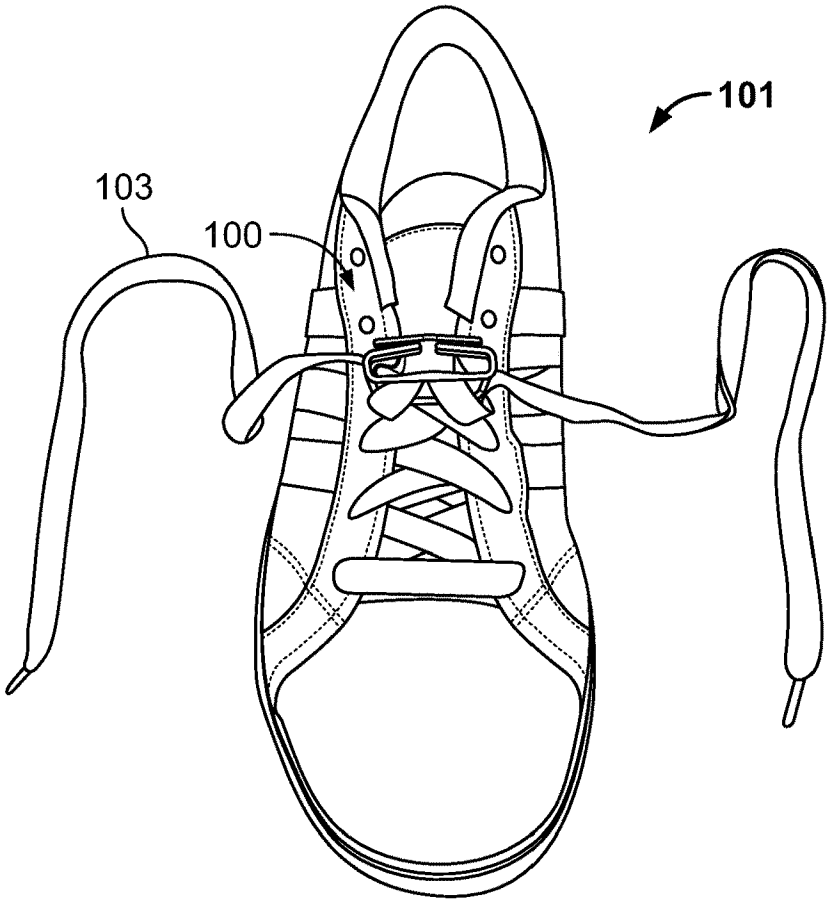
Figure 18:
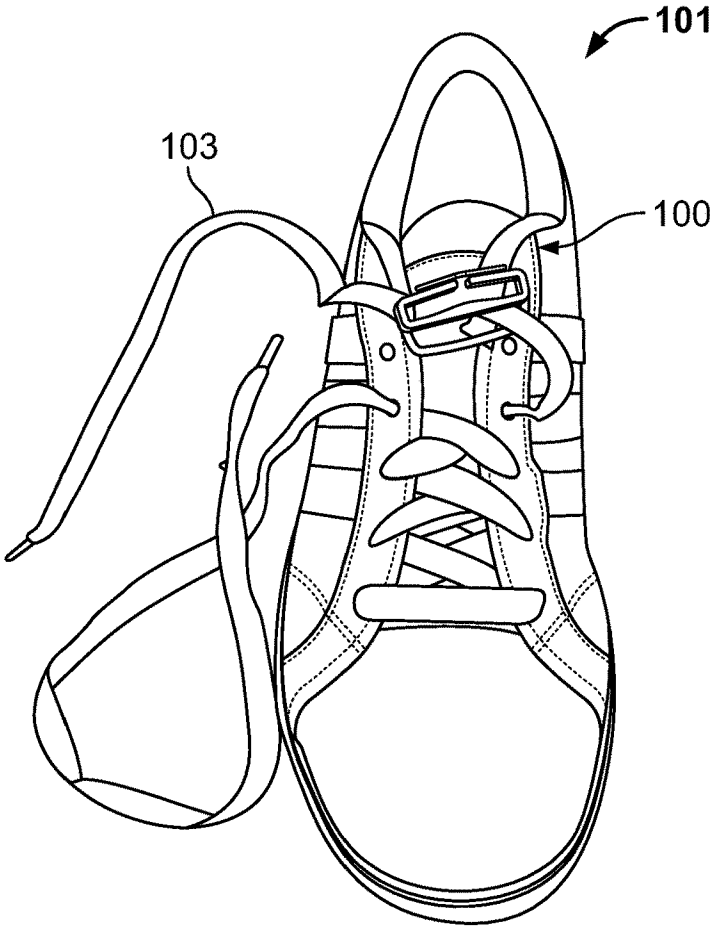

Example installation of the shoelace retainer 100 to a shoe 101 and use thereof to secure a shoelace 103 associated with the shoe 101 to the shoelace retainer 100 will now be described with reference to FIGS. 17-25. As shown, the shoe 101 includes the shoelace 103, where the shoelace 103 is configured to thread through eyelets 105 of the shoe 101 (so that the shoe 101 can ultimately be secured to a foot of an individual using the shoelace 103). In this embodiment, in connection with installing the shoelace retainer 100 to the shoe 101, the shoelace 103 is initially unthreaded from at least some of the upper eyelets 105 of the shoe 101 (FIG. 17) (e.g., such that the shoelace 103 is threaded through two bottom pairs of eyelets 105 of the shoe 101, such that the shoelace 103 is threaded through at least one bottom pair of eyelets 105 of the shoe 101, such that the shoelace 103 is threaded through three or more bottom pairs of eyelets 105 of the shoe 101, such that at least two upper pairs of eyelets 105 of the shoe 101 are not threaded, etc.). As shown in FIGS. 18 and 19, free ends 103*a*, 103*b* (or free end portions) of the shoelace 103 are then routed, threaded, etc. through the channel 118 defined by the base 108 of the shoelace retainer 100 (in a direction extending from the generally forward portion 110*a* of the body 110 to the generally rearward portion 110*b* of the body 110), such that portions of the shoelace 103 associated with each of the free ends 103*a*, 103*b* (and extending through the channel 118) generally cross (e.g., in a conventional shoe-lacing manner, etc.).

Figure 20:
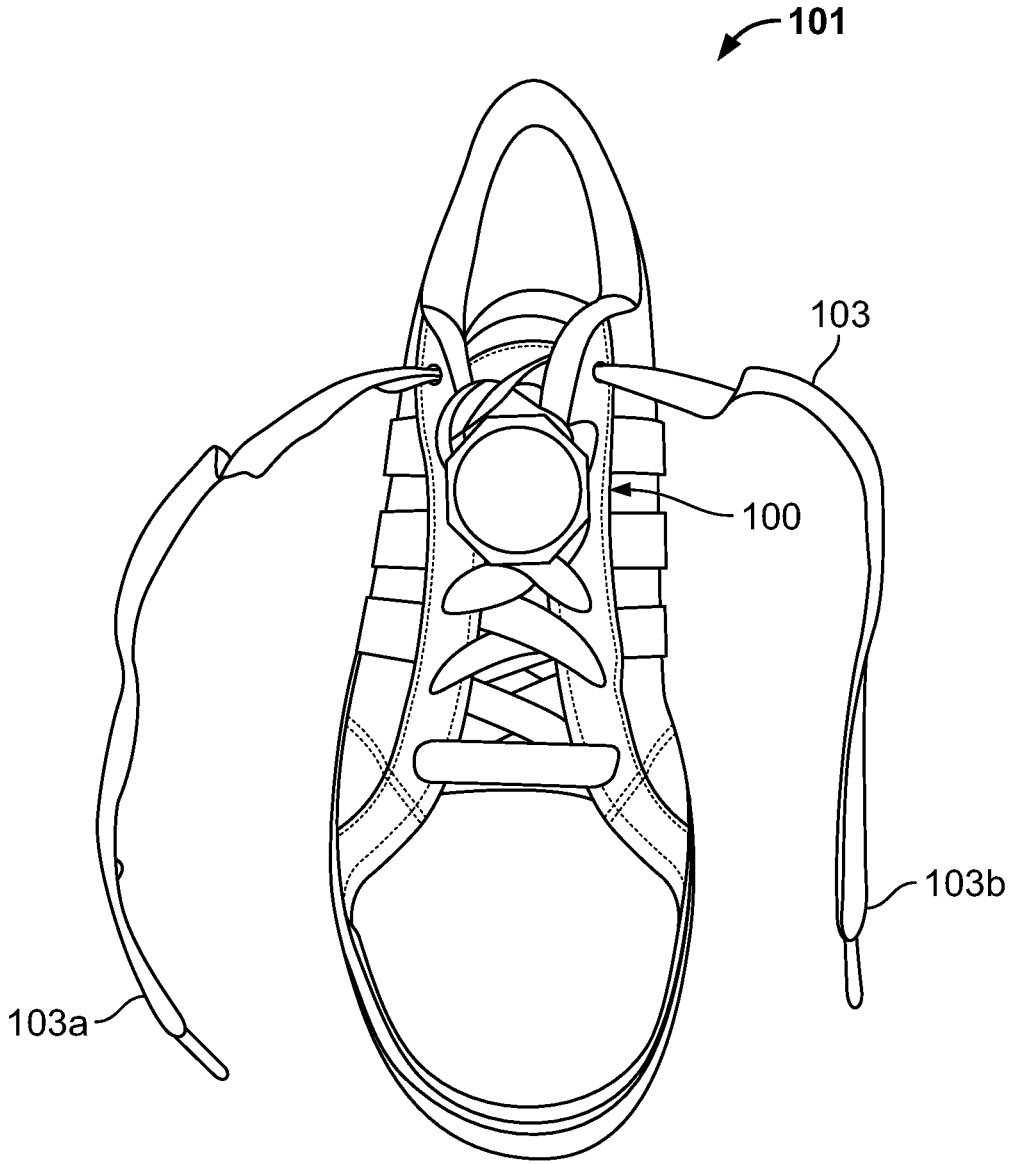
Figure 21:
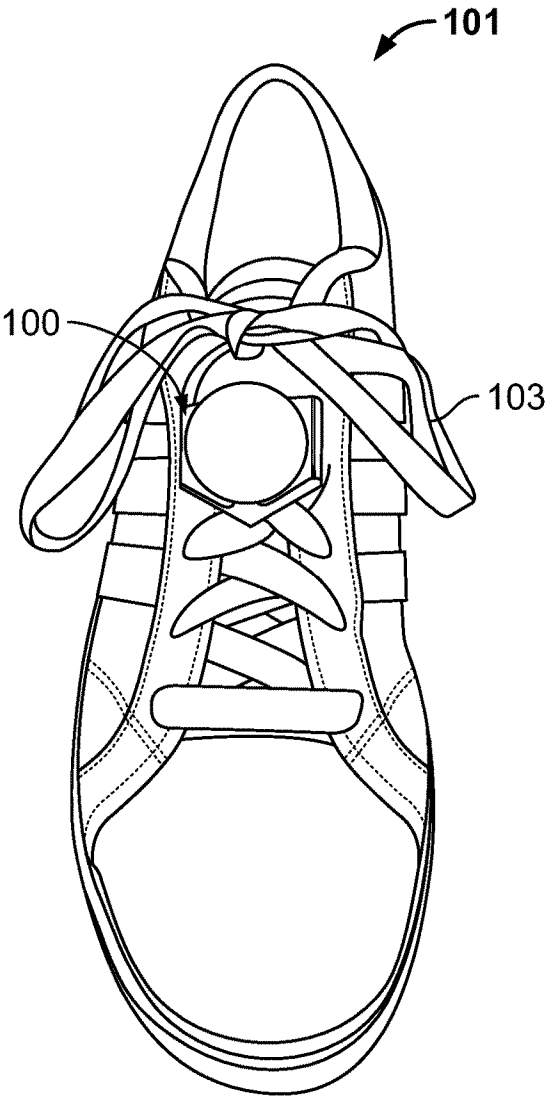

Next, as shown in FIG. 20, and with the shoelace retainer 100 now coupled to the shoe 101 (via the base 108 of the shoelace retainer 100 and via the shoelace 103 (extending through the channel 118 of the base 108)), the free ends 103*a*, 103*b* of the shoelace 103 are threaded, in a conventional manner, through the remaining open eyelets 105 of the shoe 101 (i.e., through the remaining eyelets 105 extending upward toward a foot-opening 107 of the shoe 101). At this time, the shoe 101 may be positioned on the foot of the individual (not shown) (if not already done), and the shoelace 103 tied to secure the shoe to the individual's foot (FIG. 21). As shown, in this example (and as is generally conventional) the shoelace 103 is tied in a bow knot in which the free ends 103*a*, 103*b* of the shoelace 103 are folded or formed into loops and allowed to hang loose relative to the shoe 101 (along with the free ends 103*a*, 103*b*).

Now, with the shoelace 103 tied, the shoelace retainer 100 (which is installed to the shoe 101 in the closed position in this example) is moved from the closed position (FIG. 21) to the open position (FIG. 22). As described above, this includes moving (or rotating) the cap 104 of the shoelace retainer 100 relative to the body 110 and the mount 112 (in an arcuate or off-center movement), and moving the protrusion 154 of the cap 104 out of the spacing 140 defined between the free end portions 124*a*, 126*a* of the arms 124, 126, so as to uncover the spacing 140 and at least one of the slots 136, 138 (e.g., about ninety degrees, more than about ninety degrees, etc.). Then, as shown in FIGS. 23 and 24, portions of the shoelace 103 defining the bows, as well as portions of the shoelace associated with the free ends 103*a*, 103*b*, are positioned in the first and second channels 120, 122 of the shoelace retainer 100 (through the slots 136, 138 and the spacing 140 between the free end portions 124*a*, 126*a* of the arms 124, 126) and generally under the arms 124, 126 (such that the shoelace portions extend generally through the first and second channels 120, 122 and the corresponding openings 130-134). Finally, the shoelace retainer 100 is moved from the open position back to the closed position (FIG. 25) to secure the bow portions and the free ends of the shoelace in the shoelace retainer 100 (i.e., in the first and second channels 120, 122 defined by the body 110 (and the arms 124, 126) and the cap 104).

Thus, when the shoelace retainer 100 of the present disclosure is coupled to the shoe 101, the free ends 103*a*, 103*b* of the tied shoelace 103 (generally associated with the formed bows) are positioned within the channels 120, 122 of the shoelace retainer 100 to help inhibit the bows from being inadvertently untied. As can be appreciated, when the shoelace 103 is tied in the bow knot, as is conventional, the free ends 103*a*, 103*b* of the shoelace 103 are folded or formed into the loops and allowed to hang loose over the shoe 101. However, in this hanging position, because the bow knot is a type of slip knot, the loops may be inadvertently engaged and pulled whereby the bow knot becomes undone (i.e., the shoelace 103 becomes untied). By positioning at least part of the bow knot in the shoelace retainer 100 as described above (and in the particularly formed channels 120, 122 and under the extending arms 124, 126), such inadvertent engagement of the loops of the bow knot may be avoided (and which may help resist inadvertent untying of the shoelace 103).

What's more, the illustrated shoelace retainer 100 is free of springs or other resiliently biasing members. In other words, the shoelace retainer 100 does not require springs, etc. to couple the shoelace retainer 100 to the shoe 101 or to retain the free ends 103*a*, 103*b* of the shoelace 103 (or the bow knot portions formed thereby) in the channels 120, 122 of the shoelace retainer 100. As can be appreciated, this may provide for easier operation of the shoelace retainer 100, as required strength to manipulate such springs to overcome their spring forces is not required.

FIGS. 26-36 illustrate another example embodiment of a shoelace retainer 200 for use with a shoe and including one or more aspects of the present disclosure. Again, the shoelace retainer 200 is configured (e.g., sized, shaped, constructed, etc.) to couple to a shoelace of a shoe and then retain portions of the shoelace, as threaded to the shoe, therein to help inhibit the shoelace from untying (e.g., to help inhibit a knot formed by the free ends of the shoelace from coming undone, etc.), dragging on the ground, etc.

The shoelace retainer 200 is similar to the shoelace retainer 100 described above, and operates in substantially the same manner. For example, the shoelace retainer 200 generally includes a support 202, and a cap 204 configured to removeably couple to the support 202. And, the support 202 includes a base 208, a body 210, and a mount 212. In addition, the base 208 of the support 202 includes a channel 218 extending through the base 208 and configured to receive portions of a shoelace therethrough for coupling the shoelace retainer 200 to a shoe. And, the body 210 of the support 202 includes first and second channels 220, 222 extending through the body 210, and around the mount 212. In connection therewith, arms 224, 226 of the body 210, located toward side portions of the body 210, extend generally upward from a floor 214 of the body 210 and over a portion of the channels 220, 222 (such that the arms 224, 226 of the body 210 may be viewed as defining a portion of the channels 220, 222).

Also in this embodiment, the cap 204 of the shoelace retainer 200 is configured to couple to the body 210 at the mount 212, in a position such that the cap 204 is located generally over (or above) the body 210. In particular, the cap 204 includes a boss 244, extending away from a lower surface of the cap 204, and configured to fit within an opening 246 of the mount 212 (such that the cap 204 is located generally over the arms 224, 226 of the body 210, and over slots 236, 238 defined between the arms 224, 226 and the mount 212 and over a spacing 240 defined between free end portions 224*a*, 226*a* of the arms 224, 226 (broadly, in a closed position of the shoelace retainer 200).

In this embodiment, though, and different from the shoelace retainer 100 described above, the boss 244 of the cap 204 includes teeth 244*a* located toward an end portion of the boss 244, and extending way from the boss 244 at generally opposite sides of the boss 244. The opening 246 of the mount 212 then includes apertures 246*a* formed in a floor 212*a* of the mount 212 and protruding away from the opening 246 on generally opposite sides thereof. In connection therewith, the apertures 246*a* are arranged around the opening 246 of the mount 212 so as to align with the teeth 244*a* of the boss 244 when the cap 204 is coupled to the mount 212 (e.g., such that the boss 244 of the cap 204 and the opening 246 of the mount 212 form a keyed connection, etc.). As such, when the boss 244 of the cap 204 is aligned with the opening 246 of the mount 212, the teeth 244*a* of the boss 244 extend through the apertures 246*a* and below the floor 212*a* of the mount 212. In this position, the cap 204 can be rotated relative to the mount 212, with the teeth 244*a* rotating within the opening 246 of the mount 212 below the floor 212*a* and out of alignment with the apertures 246*a* (such that the cap 204 then cannot be removed from the mount 212 when the teeth 244*a* of the boss 244 are not aligned with the apertures 246*a* of the mount 212). In this way, the floor 212*a* of the mount 212 and the teeth 244*a* of the boss 244 operate to retain the boss 244 in the opening 246 (and the cap 204 coupled to the mount 212 (in the closed position)), but allow for rotational movement of the cap 204 relative to the mount 212. This also allows the cap 204 to be selectively removed from the mount 212 when desired (by aligning the teeth 244*a* of the boss 244 with the apertures 246*a* of the mount 212 and then removing the cap 204 from the mount 212) (e.g., to move the shoelace retainer 200 to an open position and expose the slots 236, 238 and the channels 220, 222 thereof, etc.).

With that said, the shoelace retainer 200 is installed to a shoe in the same manner described above for the shoelace retainer 100, for example, when the shoelace is initially unthreaded from at least some of the eyelets of the shoe. In particular, free ends (or free end portions) of the shoelace are routed, threaded, etc. through the channel defined by the base 208 of the shoelace retainer 200 (in a direction extending again from a generally forward portion of the body 210 to a generally rearward portion of the body 210). The free ends of the shoelace are in turn threaded, in a conventional manner, through the remaining open eyelets of the shoe (i.e., through the remaining eyelets extending upward toward a foot-opening of the shoe). And, the shoe may be positioned on the foot of the individual (if not already done), and the shoelace tied to secure the shoe to the individual's foot.

Now, with the shoelace tied, the shoelace retainer 200 (which is installed to the shoe in a generally closed position, in this example, with the cap 204 coupled to the mount 212) is moved from the closed position to an open position (i.e., with the cap 204 removed from the mount 212 to expose the slots 236, 238 between the arms 224, 226 and the mount 212, to expose the spacing 240 between free end portions 224*a*, 226*a* of the arms 224, 226, and to expose the first and second channels 220, 222). As described above, this includes moving (e.g., rotating, etc.) the cap 204 of the shoelace retainer 200 relative to the body 210 and the mount 212, to align the teeth 244*a* of the boss 244 with the apertures 246*a* of the mount 212, so that the cap 204 can be disengaged from (and removed from) the opening 246 of the mount 212. Then, portions of the shoelace defining the bows, as well as portions of the shoelace associated with the free ends, are positioned in the first and second channels 220, 222 of the shoelace retainer 200 generally under the arms 224, 226 (such that the shoelace portions extend generally through the first and second channels 220, 222 at least partly below the arms 224, 226). Finally, the shoelace retainer 200 is moved from the open position back to the closed position by re-coupling the cap 204 to the mount 212.

FIGS. 37-55 illustrate another example embodiment of a shoelace retainer 300 for use with a shoe and including one or more aspects of the present disclosure. The shoelace retainer 300 is configured (e.g., sized, shaped, constructed, etc.) to couple to a shoe and then retain free end portions of a shoelace threaded to the shoe (e.g., where the shoelace is threaded to the shoe via eyelets of the shoe, etc.) to help inhibit the free ends from untying (e.g., to help inhibit a knot formed by the free ends of the shoelace from coming undone, etc.). This will be described in more detail hereinafter.

As shown in FIGS. 37-41, the illustrated shoelace retainer 300 generally includes a base 302 and a cap 304 coupled to the base 302. The base 302 includes a body 306 and arms 308 extending away from the body 306. And, a plateau 310 of each of the arms 308 extends generally horizontally away from the body 306, with an end portion 312 of each of the arms 308 then extending generally vertically upward from the plateau 310. In the illustrated embodiment, the base 302 includes two arms 308 extending away from the body 306 on generally opposite sides of the body 306. In other embodiments, however, the base 302 may include more than the two arms 308 (e.g., three arms, four arms, etc.) or fewer than the two arms 308 (e.g., one arm, no arms, etc.), for example, extending away from the body 306 in a similar manner to the arms 308.

The cap 304 of the shoelace retainer 300 is coupled to the base 302 generally at the body 306 of the base 302. In this position, the cap 304 is located generally between the arms 308 of the base 302, with an upper surface of the cap 304 generally aligned with (or generally flush with) an upper portion of the arms 308 (e.g., with an upper portion of the end portion 312 of each of the arms 308, etc.) (although this is not required in all embodiments).

With additional reference to FIGS. 42-46, the cap 304 of the shoelace retainer 300 is also removeably coupled to the base 302. In particular, the cap 304 includes a protrusion 318 configured to snap-fit into an opening 320 of the base 302. In so doing, an enlarged lip 322 of the protrusion 318 is configured to secure within the opening 320 of the base 302, generally under an upper surface of the body 306 of the base 302 (e.g., the enlarged lip 322 is configured to snap-fit into the opening 320 and position generally under the upper surface of the body 306 of the base 302, etc.). The cap 304 is then positioned, when coupled to the base 302, on the base 302 and generally between the arms 308 of the base 302 as described above. As further described below, this coupling of the cap 304 to the base 302 (via the protrusion 318) allows the cap 304 to rotate relative to the base 302. With that said, it should be appreciated that in other embodiments of the present disclosure, the cap 304 of the shoelace retainer 300 may be integral with the base 302 (e.g., with the base 302 and the cap 304 formed together as one piece, etc.), but still be moveable (or not) relative to the base 302 as described herein.

The base 302 of the shoelace retainer 300, and in particular the body 306 thereof, further includes multiple openings 326*a-d* defined along a sidewall portion 328 of the body 306. The openings 326*a-d* extend into and generally through (and are in communication with) an interior region 330 of the body 306. Corresponding pairs of the openings 326*a*, 326*c* and 326*b*, 326*d* then define channels extending through the body 306 (and through the interior region 330 of the body 306). As will be described in more detail hereinafter, the channels are then configured to receive portions of a shoelace therethrough for coupling the shoelace retainer 300 to a shoe (broadly, the base 302 of the body 306 defines means (e.g., the channels defined through the base 302 via the pairs of openings 326*a*, 326*c* and 326*b*, 326*d*, etc.) for coupling the shoelace retainer 300 to the shoe).

Figure 47:
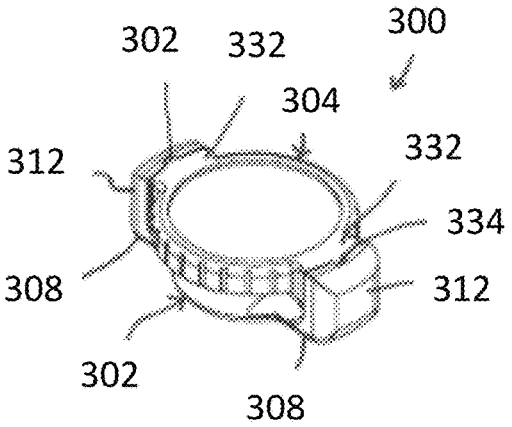
FIGS. 47 and 48 are perspective views of the shoelace retainer of FIG. 37 illustrating movement of the cap of the shoelace retainer relative to the base.
Figure 48:
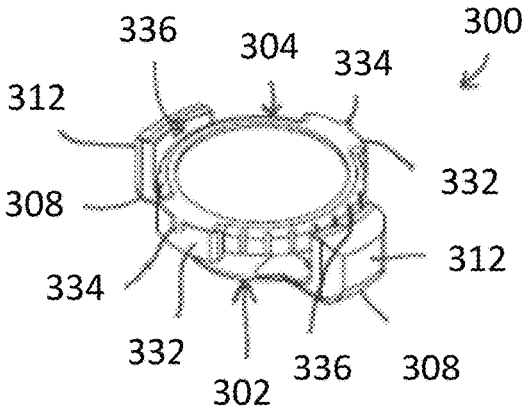
Figure 50:
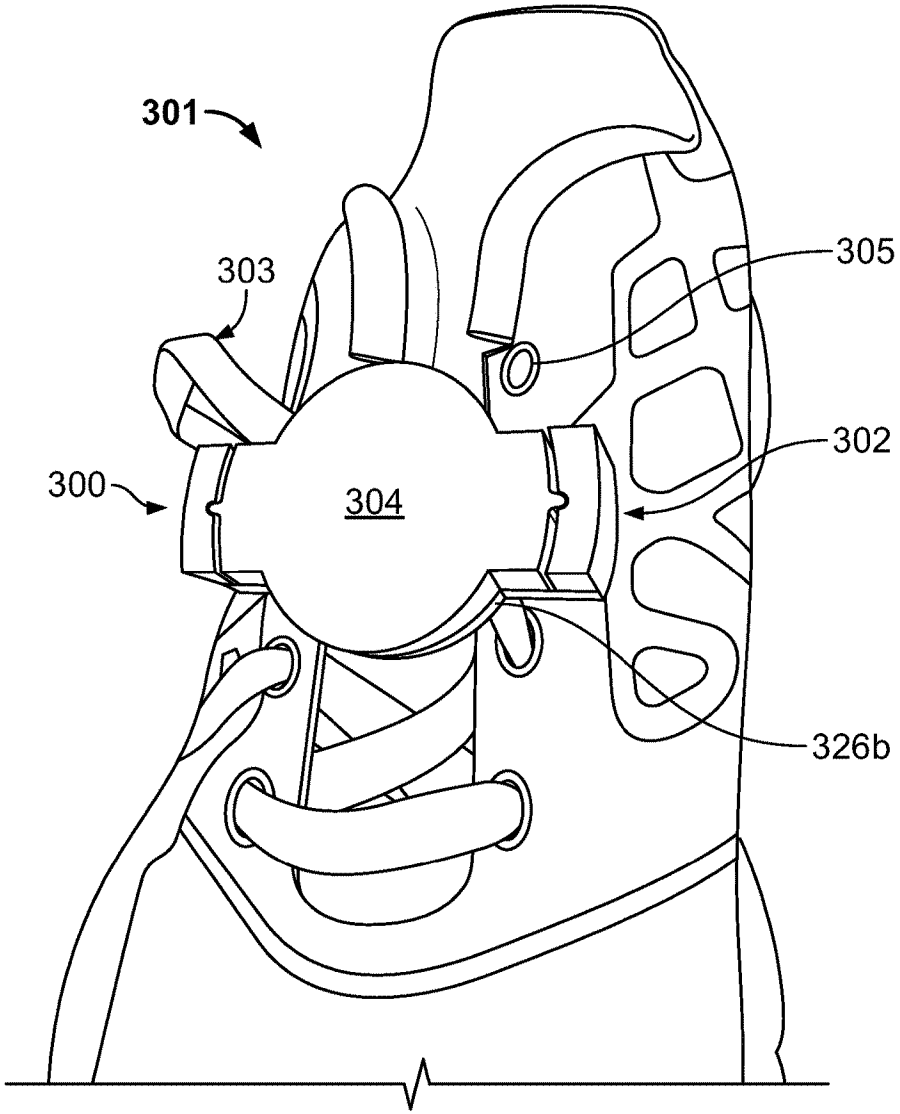
FIGS. 49-55 illustrate an example operation of installing the shoelace retainer of FIG. 37 to a shoe.
Figure 49:
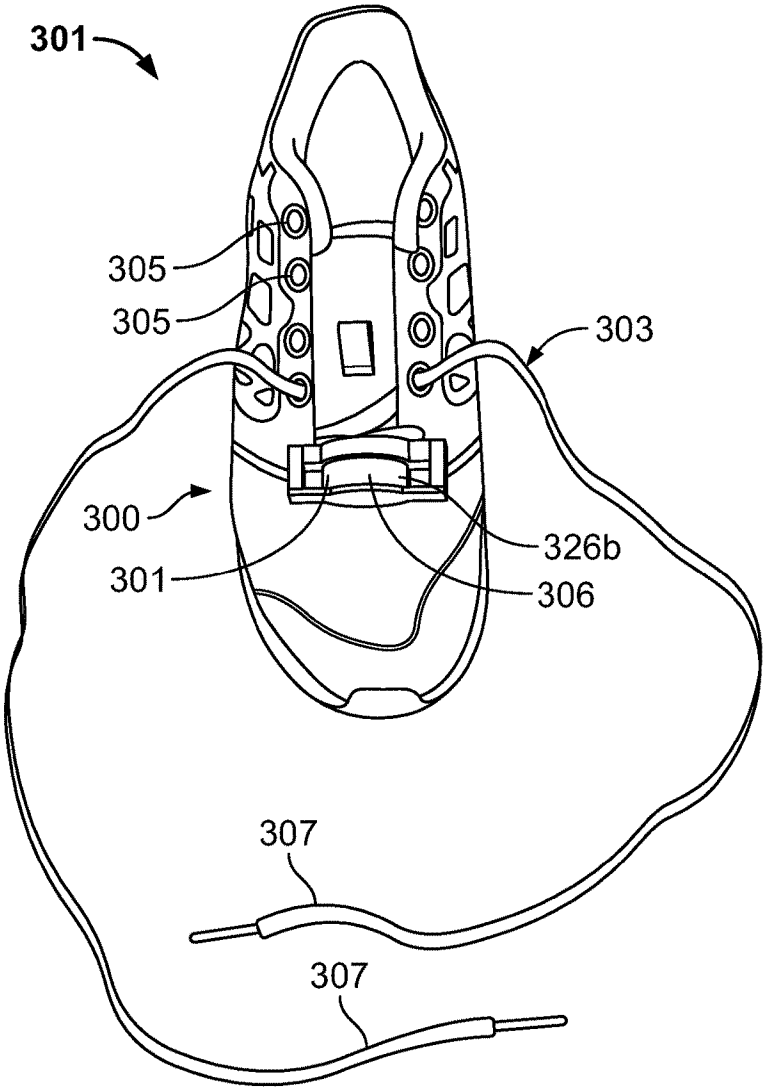

With reference now to FIGS. 47 and 48, the cap 304 of the shoelace retainer 300 is moveable (e.g., pivotable, etc.) relative to the base 302 between a closed position (FIG. 47) and an open position (FIG. 48). In the closed position, wings 332 of the cap 304 are positioned generally in alignment with the arms 308 of the base 302 (generally over the plateaus 310 of the arms 308). And, protrusions 334 of the wings 332 are configured to fit within recesses 336 of the arms 308 (specifically, of the upwardly extending vertical end portions 312 of the arms 308), to thereby help hold, secure, etc. the shoelace retainer 300 in the closed position (and to help inhibit undesired or unwanted movement of the cap 304 relative to the base 302 (e.g., to help inhibit and/or resist undesired or unwanted movement of the shoelace retainer 300 to the open position, etc.)). When desired, the shoelace retainer 300 can be moved to the open position by disengaging the protrusions 334 of the wings 332 from the recesses 336 of the arms 308, and then moving the cap 304 (e.g., rotating the cap 304, etc.) relative to the base 302 (e.g., about ninety degrees, greater than ninety degrees, less than ninety degrees, etc.).

Then, and as will be described in more detail next, when the shoelace retainer 300 is coupled to a shoe (as generally described above) and is in the open position, end portions of a shoelace (where the shoelace is threaded to a shoe) may be positioned in the shoelace retainer 300 along the plateaus 310 of the arms 308 (e.g., the free end portions of the shoelace including bow portions, etc.). The shoelace retainer 300 may then be moved to the closed position, whereby the wings 332 of the cap 304 move generally over the plateaus 310 and secure the end portions of the shoelace, when tied, in the shoelace retainer 300 (whereby receptacles defined by/between the plateaus 310 of the body's arms 308 and the wings of the cap 304 operate to help retain the end portions of the shoelace in the shoelace retainer 300). In this fashion, the cap 304 and the body 306 generally define means (e.g., the receptacles, etc.) for securing portions of the shoelace, when tied, in the shoelace retainer 300.

Figure 51:
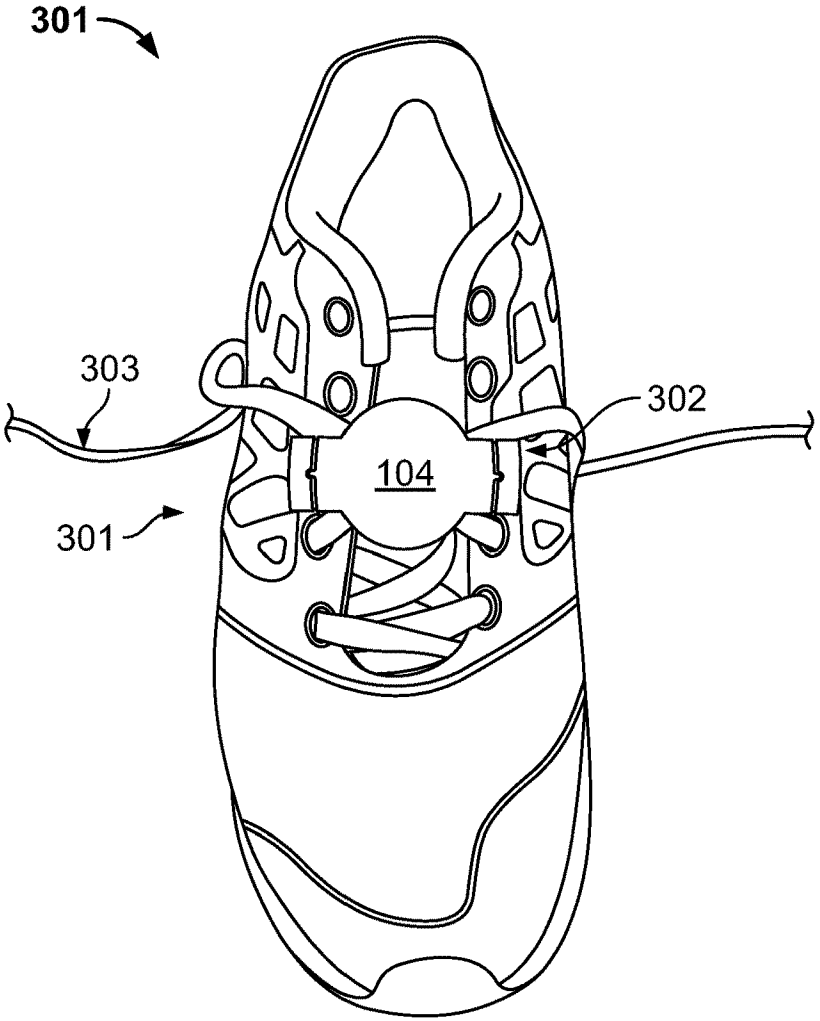

With that said, example installation of the shoelace retainer 300 to a shoe 301 and use thereof to secure a shoelace 303 associated with the shoe 301 to the shoelace retainer 300 will now be described with reference to FIGS. 49-55. As shown, the shoe 301 includes the shoelace 303, where the shoelace 303 is configured to thread through eyelets 305 of the shoe 301 (so that the shoe 301 can ultimately be secured to a foot of an individual using the shoelace 303). In this embodiment, in connection with installing the shoelace retainer 300 to the shoe 301, the shoelace 303 is initially unthreaded from at least some of the eyelets 305 of the shoe 301 (FIG. 49) (e.g., such that the shoelace 303 is threaded through two bottom pairs of eyelets 305 of the shoe 301, such that the shoelace 303 is threaded through at least one bottom pair of eyelets 305 of the shoe 301, such that the shoelace 303 is threaded through three or more bottom pairs of eyelets 305 of the shoe 301, etc.). As shown in FIGS. 49-52, free ends (or free end portions) 307 of the shoelace 303 are then routed, threaded, etc. through the channels defined by the base 302 of the shoelace retainer 300 (and the corresponding pairs of the openings 326*a*, 326*c* and 326*b*, 326*d* formed in the base 302 of the body 306), such that portions of the shoelace 303 associated with each of the free ends 307 generally cross in the interior region 330 of the body's base 302. For example, in the illustrated embodiment, one free end 307 of the shoelace 303 extends through the interior region 330 of the base 302 from opening 326*a* to opening 326*c*, and the other free end 307 of the shoelace 303 extends through the interior region 330 of the base 302 from opening 326*b* to opening 326*d* (FIG. 51).

Figure 52:
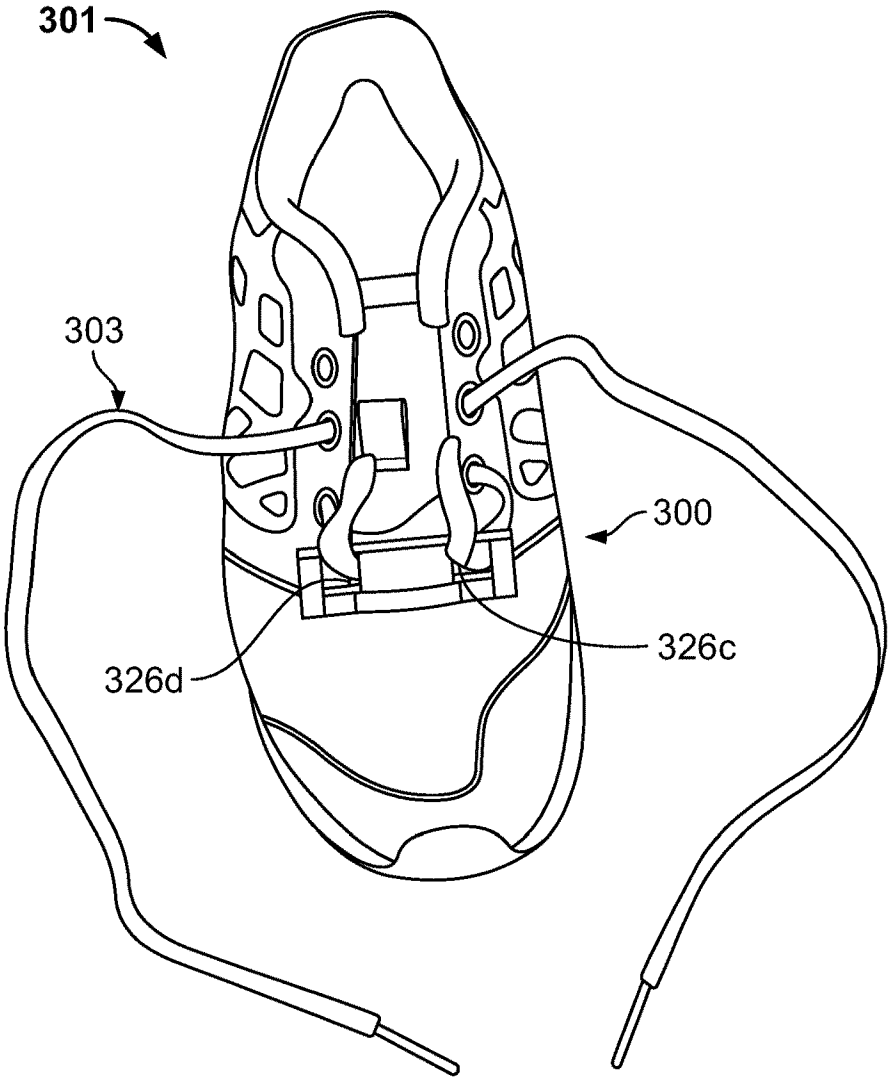
Figure 53:
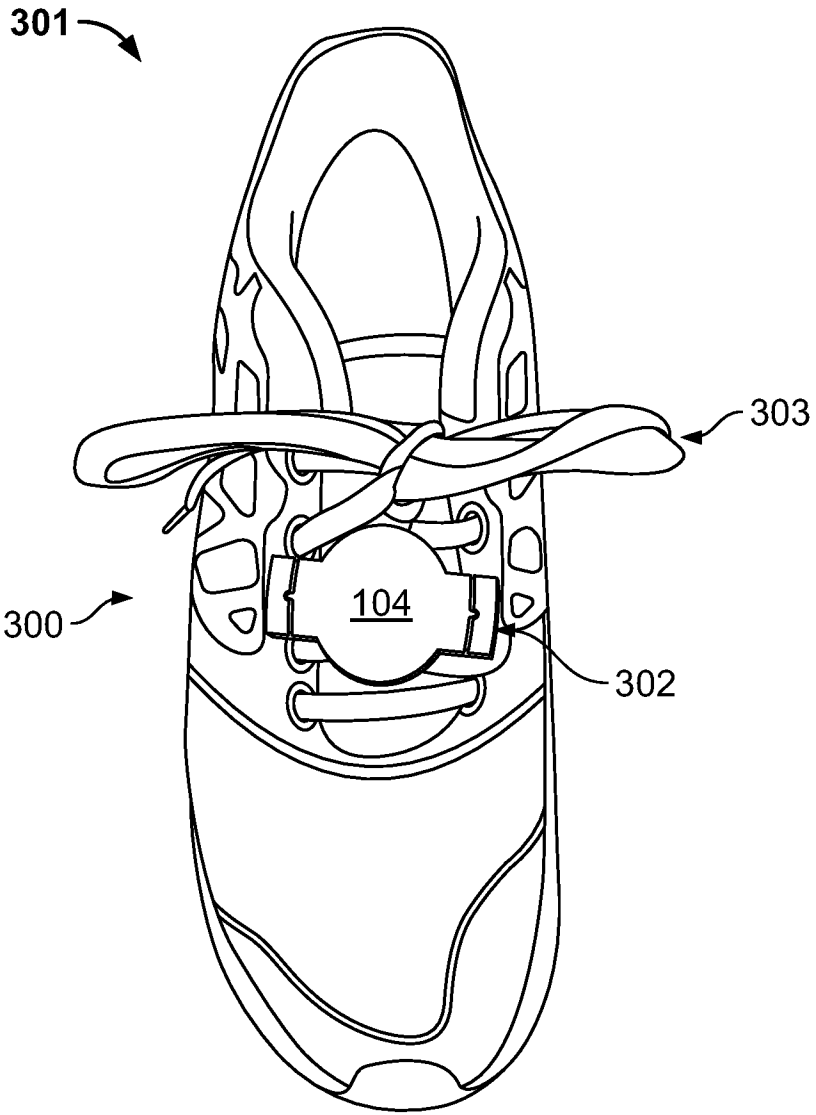
Figure 55:
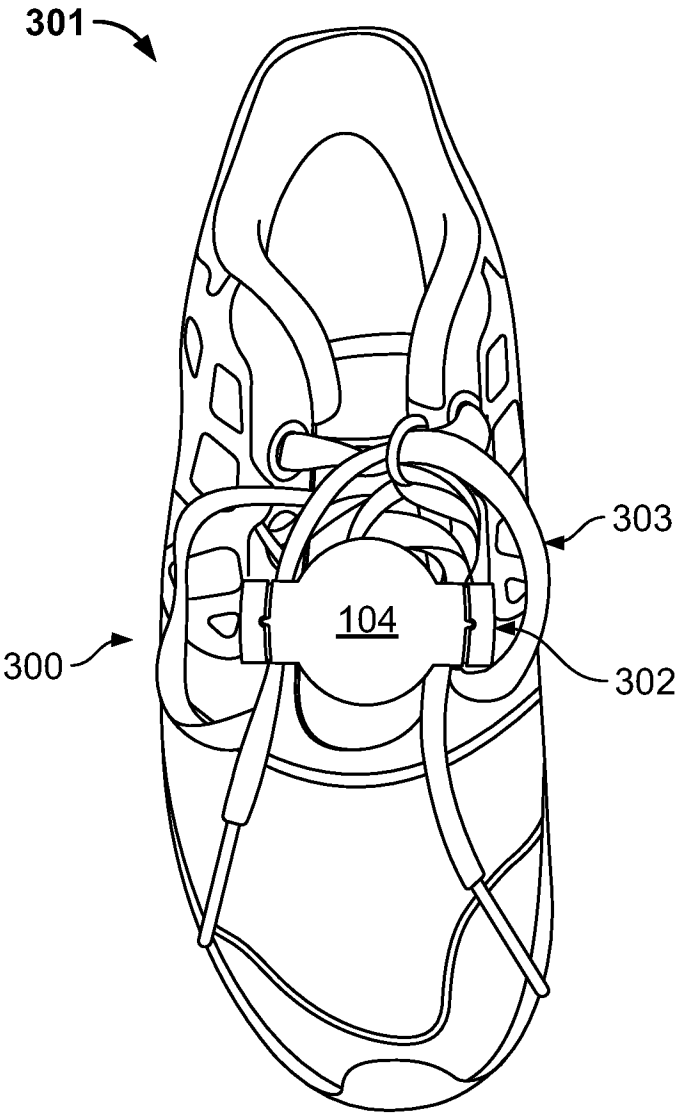
Figure 56:
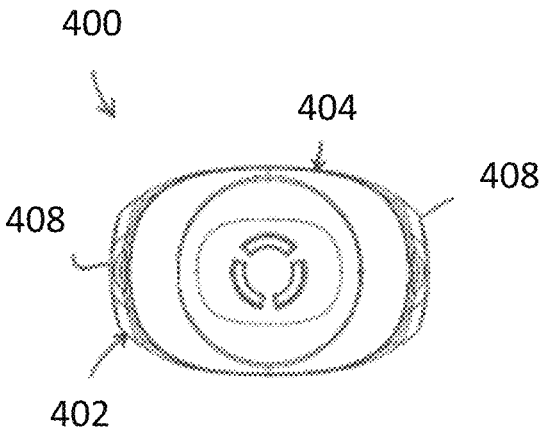
FIG. 56 is a top plan view of another example embodiment of a shoelace retainer including one or more aspects of the present disclosure.
Figure 57:
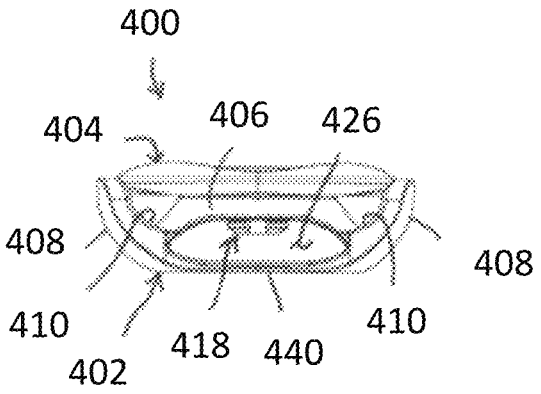
FIG. 57 is a front elevation view of the shoelace retainer of FIG. 56.
Figure 58:
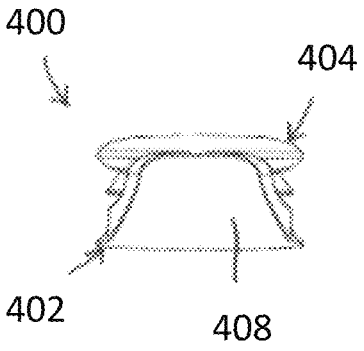
FIG. 58 is a side elevation view of the shoelace retainer of FIG. 56.
Figure 59:
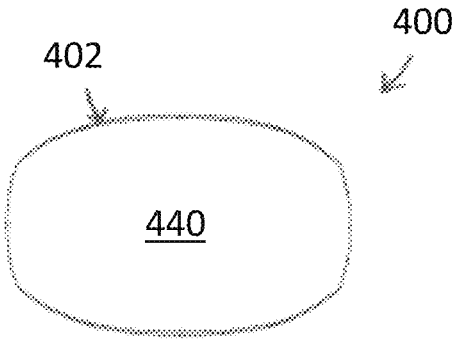
FIG. 59 is a bottom plan of the shoelace retainer of FIG. 56.

Next, as shown in FIG. 52, and with the shoelace retainer 300 now coupled to the shoe 301 (via the shoelace 303), the free ends 307 of the shoelace 303 are threaded, in a conventional manner, through the remaining open eyelets 305 of the shoe 301 (i.e., through the remaining eyelets 305 extending upward toward a foot-opening of the shoe 301). At this time, the shoe 301 may be positioned on the foot of the individual (not shown), and the shoelace 303 tied to secure the shoe 301 to the individual's foot (FIG. 53). As shown, in this example (and as is generally conventional) the shoelace 303 is tied in a bow knot in which the free ends 307 of the shoelace 303 are folded or formed into loops and allowed to hang loose relative to the shoe 301 (along with the free ends).

Figure 54:
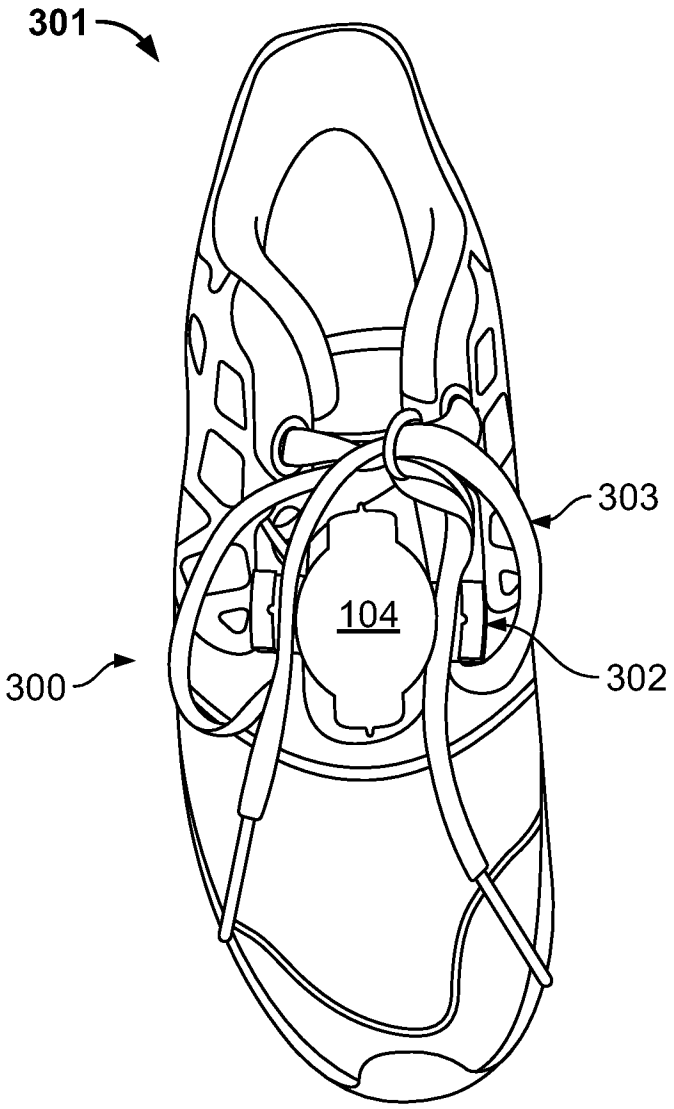

Now, with the shoelace 303 tied, the shoelace retainer 300 (which is installed to the shoe 301 in the closed position in this example) is moved from the closed position (FIG. 53) to the open position (FIG. 54). As described above, this includes moving the cap 304 of the shoelace retainer 300 relative to the base 302, so that the wings 332 of the cap 304 are moved away from the arms 308 of the base 302 (e.g., about ninety degrees, etc.). Then, as shown in FIG. 54, portions of the shoelace 303 defining the bows, as well as portions of the shoelace 303 associated with the free ends 307, are each positioned in the shoelace retainer 300 adjacent the plateaus 310 of the arms 308 (such that the shoelace portions extend generally across the plateaus 310 between the body 306 of the base 302 and the corresponding vertically extending end portions 312 of the arms 308). Finally, the shoelace retainer 300 is moved from the open position back to the closed position (FIG. 55) to secure the bow portions and the free ends 307 of the shoelace 303 in the shoelace retainer 300 (i.e., in the receptacles defined by the plateaus 310 of the base's arms 308, the body 306 of the base 302, and the wings 332 of the cap 304).

Thus, when the shoelace retainer 300 of the present disclosure is coupled to the shoe 301, the free ends 307 of the tied shoelace 303 (generally associated with the formed bows) are positioned within the receptacles of the shoelace retainer 300 to help inhibit the bows from being inadvertently untied. As can be appreciated, when the shoelace 303 is tied in the bow knot, as is conventional, the free ends 307 of the shoelace are folded or formed into the loops and allowed to hang loose over the shoe. However, in this position, because the bow knot is a type of slip knot, the loops may be inadvertently engaged and pulled whereby the bow knot becomes undone (i.e., the shoelace 303 becomes untied). By positioning at least part of the bow knot in the shoelace retainer 300 as described above, such inadvertent engagement of the loops of the bow knot may be avoided (and which may help resist inadvertent untying of the shoelace 303).

What's more, the illustrated shoelace retainer 300 is free of springs. In other words, the shoelace retainer 300 does not require springs to couple the shoelace retainer 300 to the shoe 301 or to retain the free end 307 of the shoelace 303 (or the bow knot portions formed thereby) in the receptacles of the shoelace retainer 300. As can be appreciated, this may provide for easier operation of the shoelace retainer 300, as required strength to manipulate such springs to overcome their spring forces is not required.

FIGS. 56-72 illustrate another example embodiment of a shoelace retainer 400 for use with a shoe and including one or more aspects of the present disclosure. Again, the shoelace retainer 400 is configured (e.g., sized, shaped, constructed, etc.) to couple to a shoe and then retain free ends of a shoelace threaded to the shoe to help inhibit the free ends from untying (e.g., to help inhibit a knot formed by the free ends of the shoelace from coming undone, etc.).

The shoelace retainer 400 is similar to the shoelace retainer 300 described above, and operates in substantially the same manner (such that the above description for the shoelace retainer 300 generally applies to the shoelace retainer 400). For example, as shown in FIGS. 56-60, the shoelace retainer 400 generally includes a base 402 and a cap 404 coupled to the base 402. The base 402 includes a body 406 and arms 408 extending away from the body 406. And, a plateau 410 of each of the arms 408 extends generally away from the body 406, with a free end portion of each of the arms 408 then extending generally vertically upward from the plateau 410. The cap 404 of the shoelace retainer 400, then, is coupled to the base 402 generally at the body 406 of the base 402. In this position, the cap 404 is located generally between the arms 408 of the base 402, with an upper surface of the cap 404 generally aligned with (or generally flush with) an upper portion (e.g., the free end portion, etc.) of the arms 408 (although this is not required in all embodiments).

Figure 60:
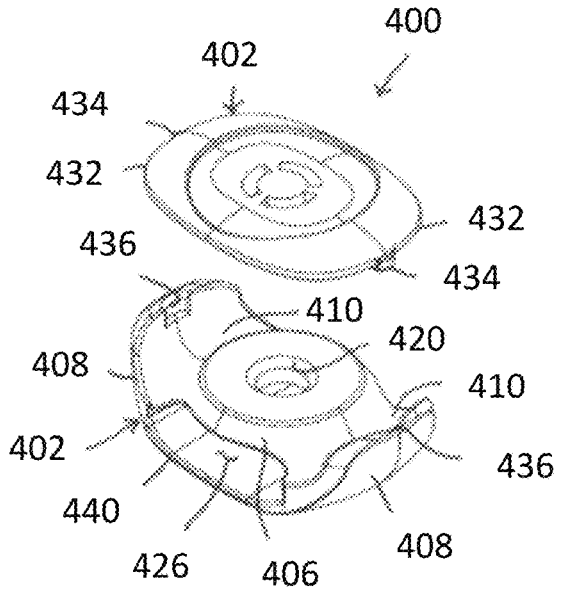
FIG. 60 is an exploded perspective view of the shoelace retainer of FIG. 56.
Figure 61:
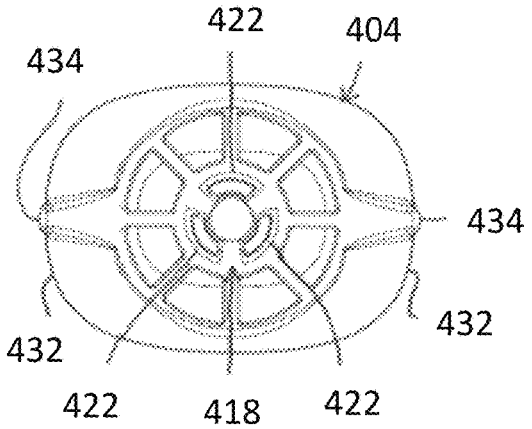
FIG. 61 is a bottom plan view of a cap of the shoelace retainer of FIG. 56.
Figure 62:
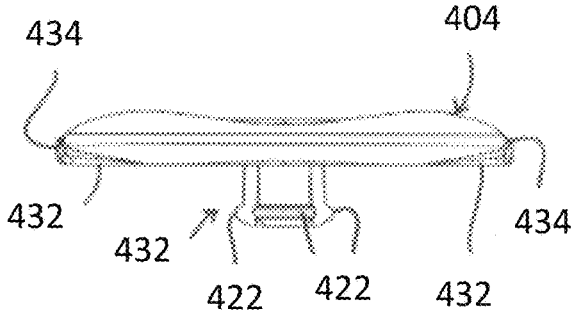
FIG. 62 is a front elevation view of the cap of FIG. 61.
Figure 63:
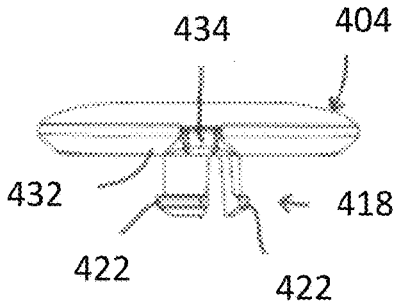
FIG. 63 is a side elevation view of the cap of FIG. 61.

In addition, the cap 404 of the shoelace retainer 400 is removeably coupled to the base 402. In particular, and with additional reference to FIGS. 61-63, a protrusion 418 of the cap 404 (defining multiple prongs) is configured to snap-fit into an opening 420 of the base 402 (FIG. 60). In so doing, an enlarged lip 422 of the protrusion 418 (in particular, of each of the multiple prongs) is configured to secure within the opening 420 of the base 402 generally under an upper surface of the body 406 of the base 402 (FIG. 57) (e.g., the enlarged lip 422 is configured to snap-fit into the opening 420 and position generally under the upper surface of the body 406 of the base 402, etc.). The cap 404 can then be positioned, as described above, on the base 402 generally between the arms 408 of the base 402 (whereby the protrusion 418 allows for pivotable movement of the cap 404 relative to the base 402).

Figure 64:
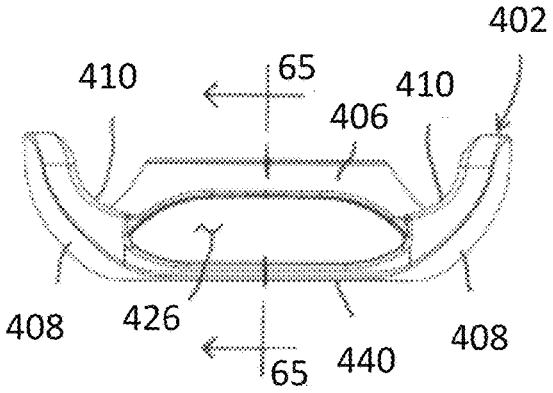
FIG. 64 is a side elevation view of a base of the shoelace retainer of FIG. 56.
Figure 65:
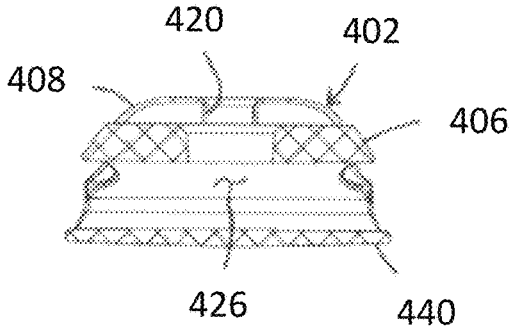
FIG. 65 is a section view of the base taken in a plane including line 65-65 in FIG. 64.
Figure 66:
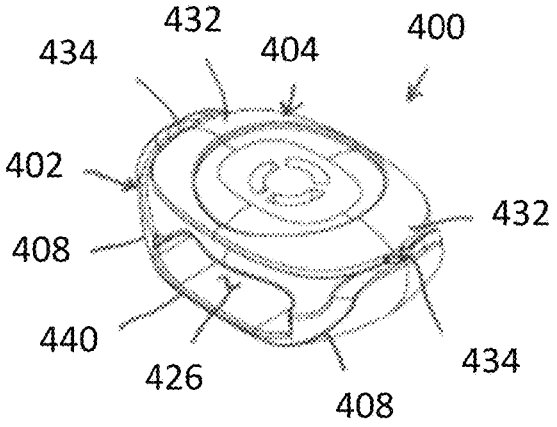
FIGS. 66 and 67 are perspective views of the shoelace retainer of FIG. 56 illustrating movement of the cap of the shoelace retainer relative to the base.
Figure 67:
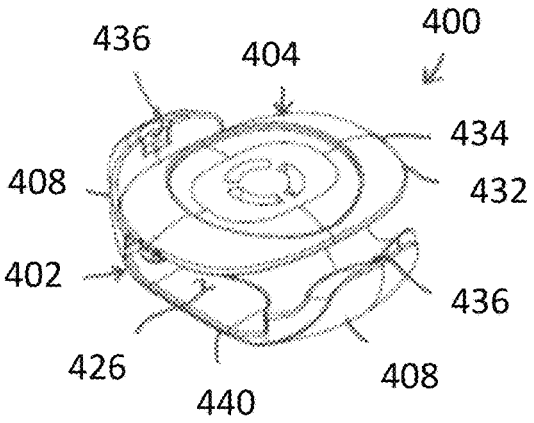

With further reference to FIGS. 64 and 65, in this embodiment, and different from the shoelace retainer 300 described above, the base 402 of the shoelace retainer 400 includes a leg 440 extending between the arms 408. The leg 440 defines an opening 426 that extends through the base 402 generally between the leg 440 and the body 406 of the base 402. In connection therewith, the opening 426 may be viewed as defining a channel (extending through the opening 426 and through the base 402) configured to receive portions of a shoelace therethrough for coupling the shoelace retainer 400 to a shoe (broadly, the base 402 defines means (e.g., the channel, together with the leg 440 and the body 406 of the base 402 defining the channel; etc.) for coupling the shoelace retainer 400 to the shoe). The cap 404 of the shoelace retainer 400 is then moveable (e.g., pivotable, etc.) relative to the base 402 between a closed position (FIG. 66) and an open position (FIG. 67), in a similar manner to the shoelace retainer 300 described above, to ultimately secure free end portions of a shoelace to the shoelace retainer 400.

Figure 69:
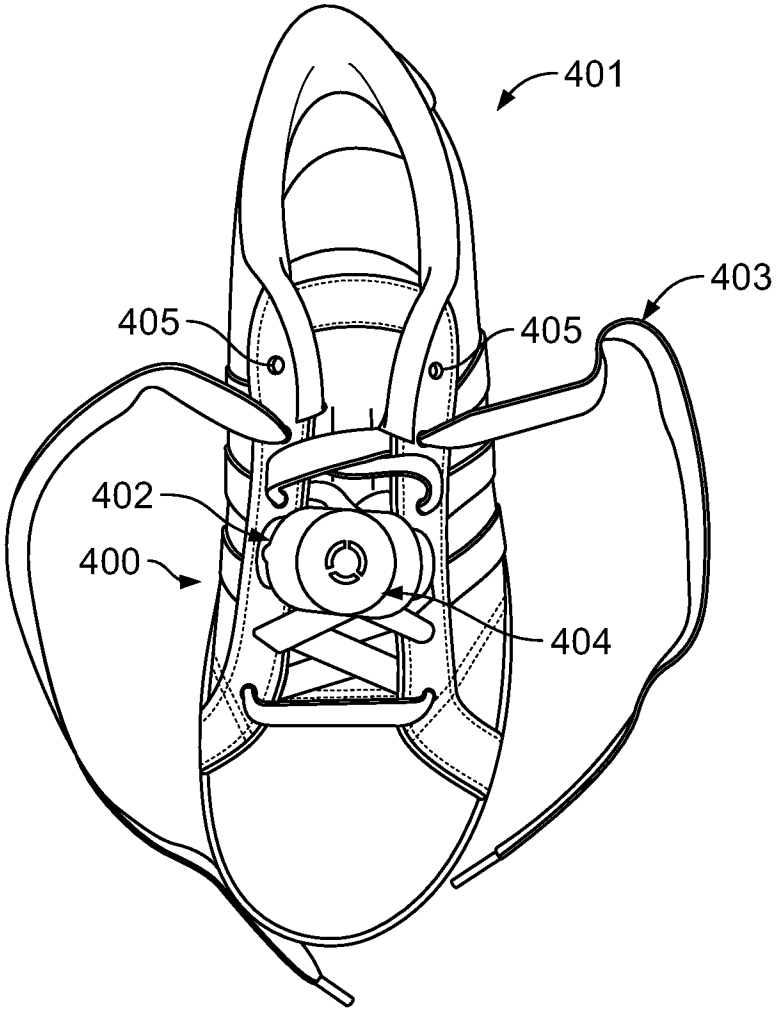
FIGS. 68-72 illustrate an example operation of installing the shoelace retainer of FIG. 56 to a shoe.
Figure 68:
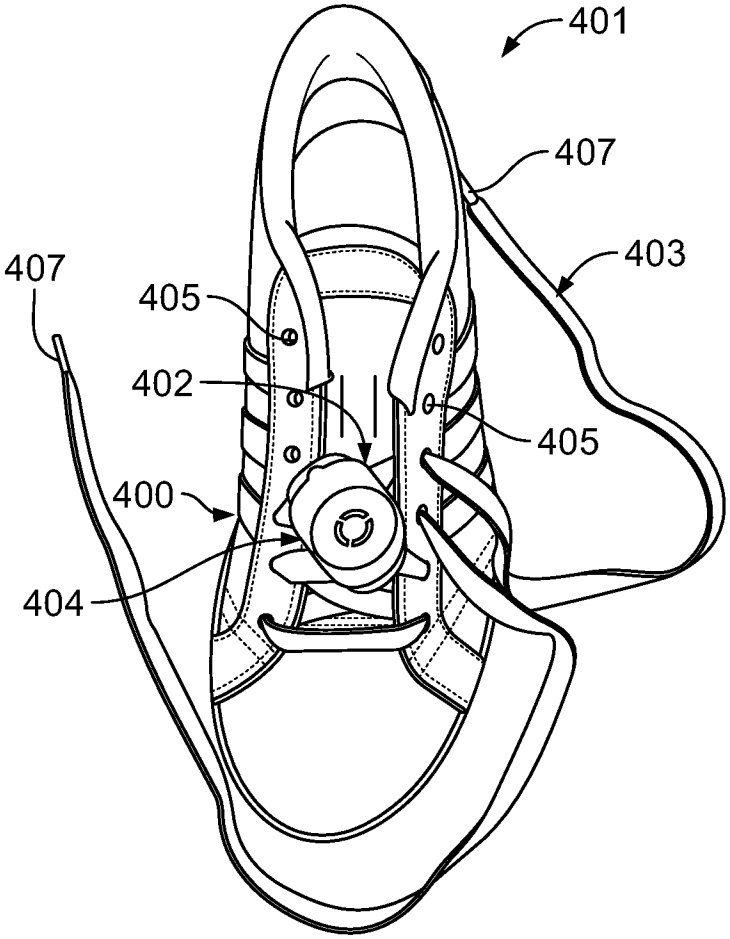
Figure 71:
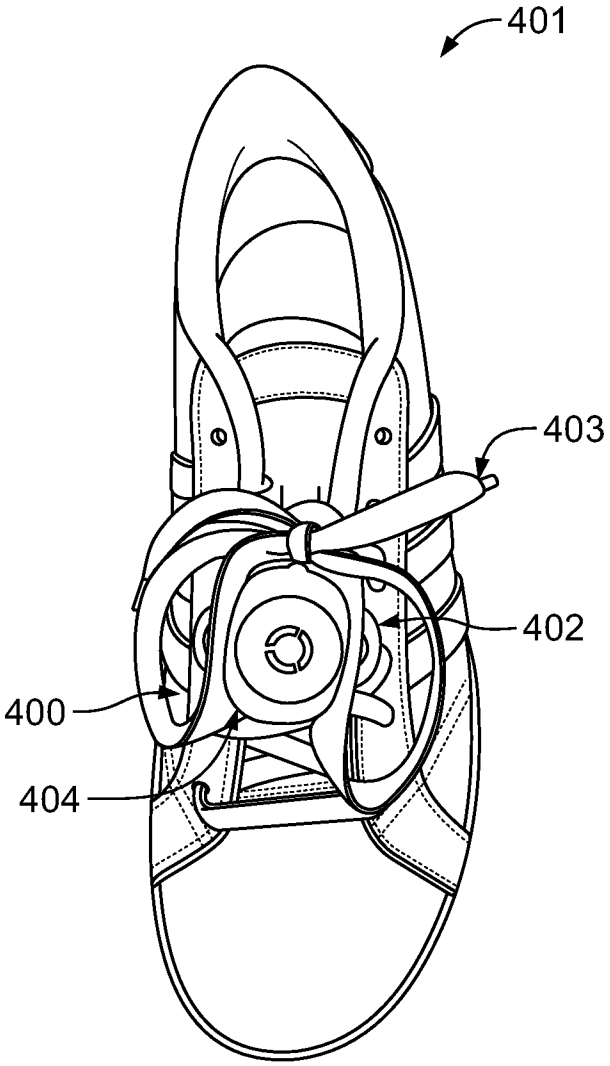
Figure 70:
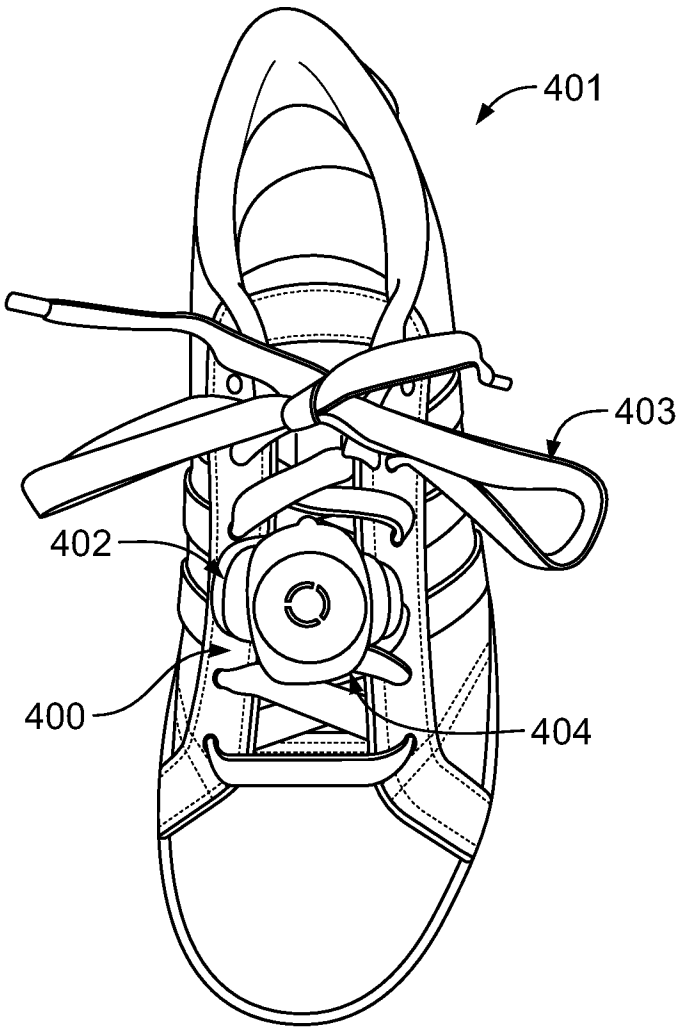
Figure 72:
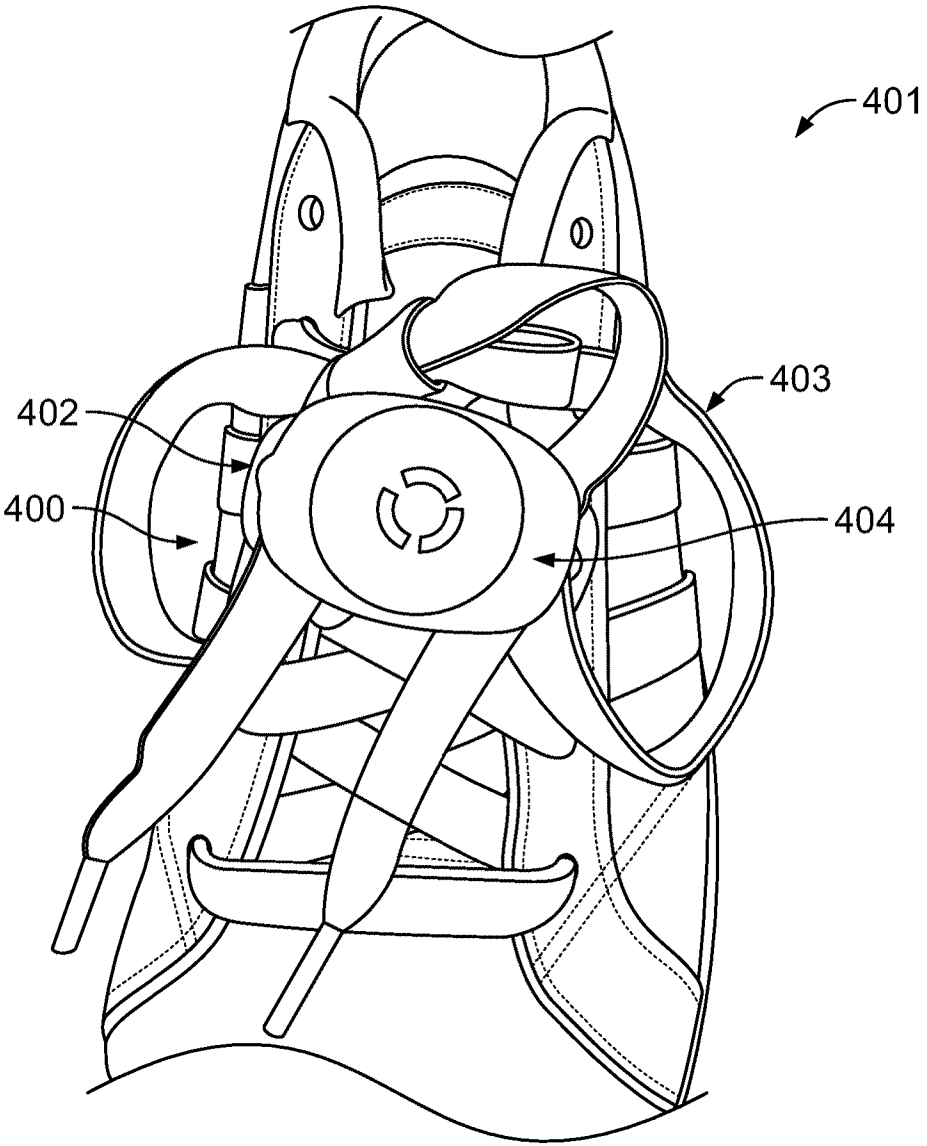
Figure 73:
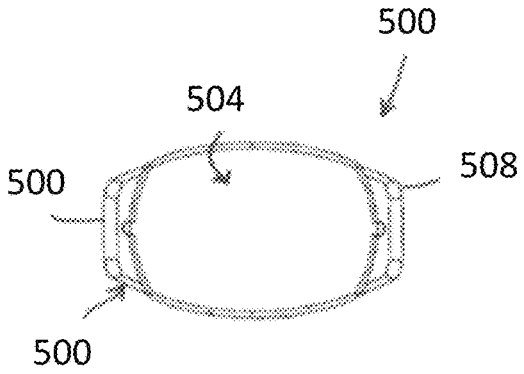
FIG. 73 is a top plan view of another example embodiment of a shoelace retainer including one or more aspects of the present disclosure.

With that said, example installation of the shoelace retainer 400 to a shoe 401 and use thereof to secure a shoelace 403 associated with the shoe 401 to the shoelace retainer 400 will now be described with reference to FIGS. 68-72. Shoelace 403 is initially unthreaded from at least some of eyelets 405 of the shoe 401 (FIG. 68). Free ends 407 of the shoelace 403 are then routed, threaded, etc. through the channel defined by the opening 426 of the base 402, such that portions of the shoelace 403 associated with each of the free ends 407 generally cross within the opening 426 (FIGS. 68 and 69). Next, and with the shoelace retainer 400 now coupled to the shoe 401 (via the shoelace 403), the free ends 407 of the shoelace 403 are threaded, in a conventional manner, through the remaining open eyelets 405 of the shoe 401 (FIG. 69). At this time, the shoe 401 may be positioned on the foot of the individual (not shown), and the shoelace 403 tied to secure the shoe 401 to the individual's foot (FIG. 70). As shown, in this example (and as is generally conventional) the shoelace 403 is tied in a bow knot in which the free ends 407 of the shoelace 403 are folded or formed into loops and allowed to hang loose relative to the shoe 401 (along with the free ends).

Now, with the shoelace 403 tied, the shoelace retainer 400 (which is installed to the shoe 401) is moved from the closed position to the open position (FIG. 70). As described above, this includes moving the cap 404 of the shoelace retainer 400 relative to the base 402, so that the wings 232 of the cap 404 are moved away from the arms 408 of the base 402. Then, portions of the shoelace 403 defining the bows, as well as portions of the shoelace 403 associated with the free ends 407, are each positioned in the shoelace retainer 400 adjacent the plateaus 410 of the arms 408 (such that the shoelace portions extend generally across the plateaus 410 between the body 406 of the base 402 and the corresponding vertically extending end portions of the arms 408). Finally, the shoelace retainer 400 is moved from the open position to the closed position (FIG. 72) to secure the bow portions and the end portions 407 of the shoelace 403 in the shoelace retainer 400 (i.e., in receptacles defined by the plateaus 410 of the base's arms 408, the body 406 of the base 402, and the wings 232 of the cap 404).

FIGS. 73-79 illustrate another example embodiment of a shoelace retainer 500 for use with a shoe and including one or more aspects of the present disclosure. Again, the shoelace retainer 500 is configured (e.g., sized, shaped, constructed, etc.) to couple to a shoe and then retain free ends of a shoelace threaded to the shoe to help inhibit the free ends from untying (e.g., to help inhibit a knot formed by the free ends of the shoelace from coming undone, etc.).

The shoelace retainer 500 is similar to the shoelace retainers 300, 400 described above, and operates in substantially the same manner (such that the above descriptions for the shoelace retainers 300, 400 generally apply to the shoelace retainer 500). For example, the shoelace retainer 500 generally includes a base 502 and a cap 504 coupled to the base 502. The base 502 includes a body 506 and arms 508 extending away from the body 506. And, a plateau 310 of each of the arms 508 extends generally away from the body 506, with a free end portion of each of the arms 508 then extending generally vertically upward from the plateau 310. The cap 504 of the shoelace retainer 500, then, is coupled to the base 502 generally at the body 506 of the base 502. In this position, the cap 504 is located generally between the arms 508 of the base 502, with an upper surface of the cap 504 generally aligned with (or generally flush with) an upper portion (e.g., the free end portion, etc.) of the arms 508 (although this is not required in all embodiments).

Figure 74:
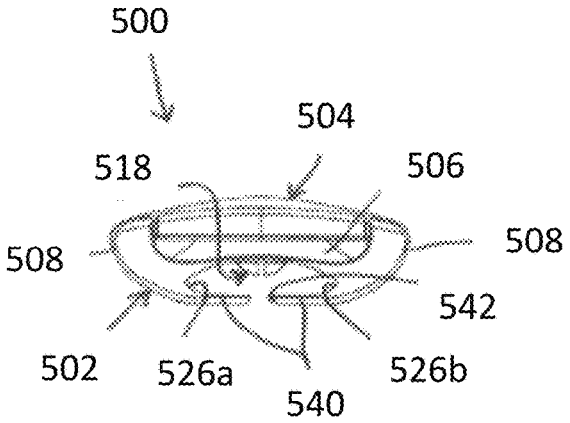
FIG. 74 is a front elevation view of the shoelace retainer of FIG. 73.
Figure 75:
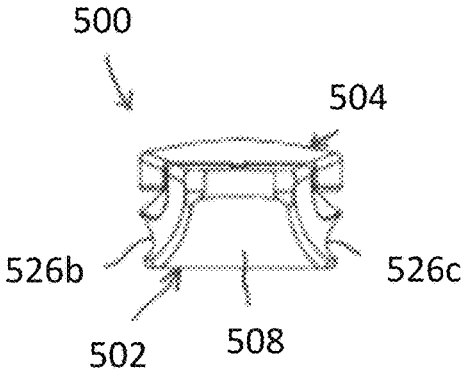
FIG. 75 is a side elevation view of the shoelace retainer of FIG. 73.
Figure 76:
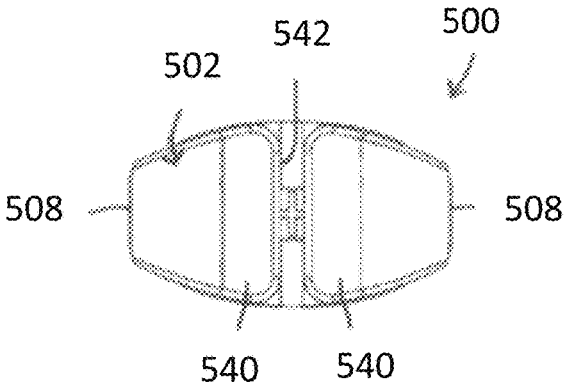
FIG. 76 is a bottom plan of the shoelace retainer of FIG. 73.
Figure 77:
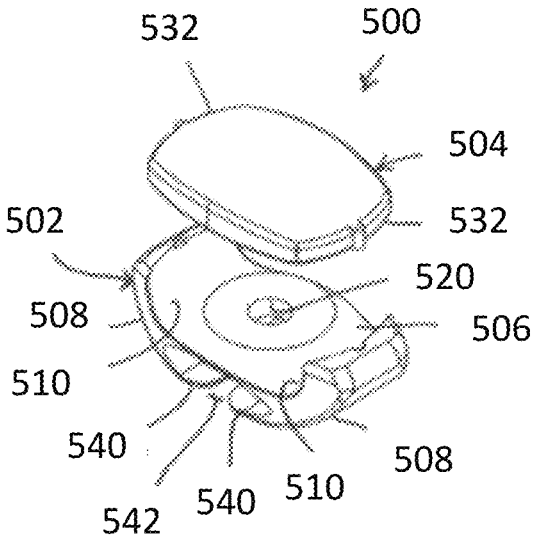
FIG. 77 is an exploded perspective view of the shoelace retainer of FIG. 73.
Figure 78:
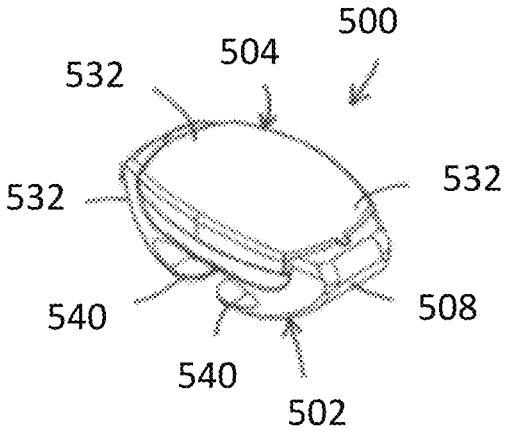
FIGS. 78 and 79 are perspective views of the shoelace retainer of FIG. 73 illustrating movement of the cap of the shoelace retainer relative to the base.
Figure 79:
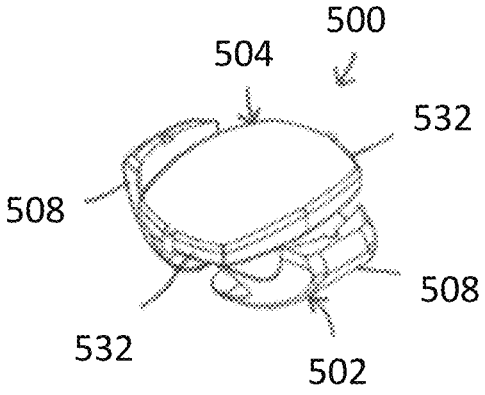
Figure 80:
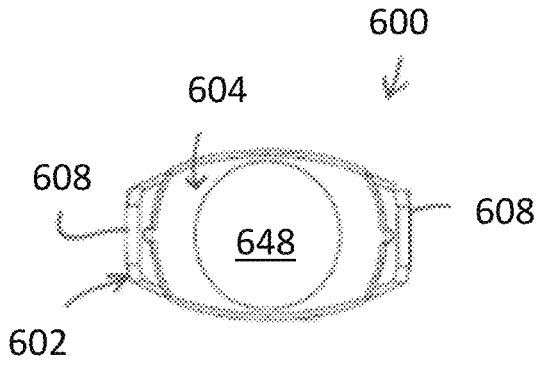
FIG. 80 is a top plan view of another example embodiment of a shoelace retainer including one or more aspects of the present disclosure.
Figure 81:
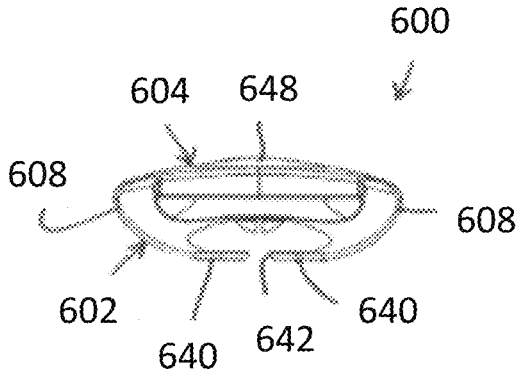
FIG. 81 is a front elevation view of the shoelace retainer of FIG. 80.
Figure 82:
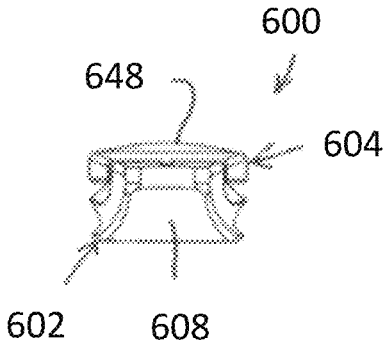
FIG. 82 is a side elevation view of the shoelace retainer of FIG. 80.
Figure 83:
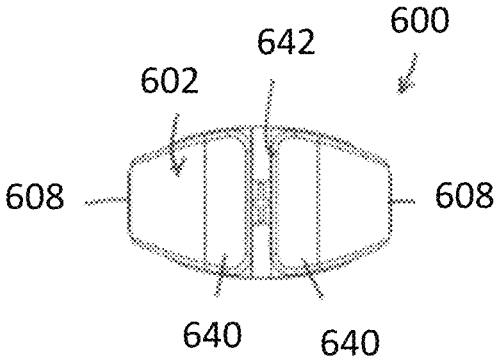
FIG. 83 is a bottom plan of the shoelace retainer of FIG. 80.

In addition, the cap 504 of the shoelace retainer 500 is removeably coupled to the base 502. In particular, a protrusion 518 of the cap 504 is configured to snap-fit into an opening 520 of the base 502 (FIG. 74). In so doing, an enlarged lip 522 of the protrusion 518 is configured to secure within the opening 520 of the base 502 generally under an upper surface of the body 506 of the base 502 (e.g., the enlarged lip 522 is configured to snap-fit into the opening 520 and position generally under the upper surface of the body 506 of the base 502, etc.). The cap 504 can then be positioned, as described above, on the base 502 generally between the arms 508 of the base 502 (whereby the protrusion 518 allows for pivotable movement of the cap 504 relative to the base 502).

In this embodiment, and different from the shoelace retainer 300 described above, the base 502 of the shoelace retainer 500 includes first and second legs 540, and a spacing 542 defined between end portions of the legs 540. The legs 540 generally define openings 526*a-d* relative to the base (generally between the legs 540 and the body 506 of the base 502). Corresponding pairs of the openings 526*a*, 526*c* and 526*b*, 526*d* then define pathways (as part of one or more channels) extending through the body 506. The pathways are configured to receive portions of a shoelace therethrough for coupling the shoelace retainer 500 to a shoe (broadly, the base 502 defines means (e.g., the pathways, together with the legs 540 and the body 506 of the base 502 defining the pathways; etc.) for coupling the shoelace retainer 500 to the shoe). Also in this embodiment, the shoelace retainer 500 can be coupled to a shoe (e.g., the shoelace 303 of the shoe 301, the shoelace 403 of the shoe 401, etc.) without unthreading a shoelace from eyelets of the shoe. This will be described more below. The cap 504 of the shoelace retainer 500 is then moveable (e.g., pivotable, etc.) relative to the base 502 between a closed position (FIG. 78) and an open position (FIG. 79), in a similar manner to the shoelace retainers 300, 400 described above, to ultimately secure free end portions of a shoelace to the shoelace retainer 500.

With that said, the shoelace retainer 500 of this embodiment may be installed to a shoe while a shoelace of the shoe is fully laced and while the shoelace is even tied (taking these distinctions into account, the shoelace retainer 500 then operates in a generally similar manner to that described above for the shoelace retainers 300, 400). In particular in this embodiment, the shoelace retainer 500 can be coupled to the shoe by simply positioning portions of the shoelace, already threaded through the eyelets of the shoe, through the spacing 542 between the end portions of the legs 540, thereby positioning the shoelace (specifically, crossing portions of the shoelace already threaded to the eyelets of the shoe) into the pathways of the body 506 of the shoelace retainer 500 (defined by the openings 526*a-d* between the legs 540 of the body 506 and the body 506 of the base 502).

Next, with the shoelace retainer 500 now coupled to the shoe (via the threaded shoelace), and with the shoelace already tied or subsequently tied in a bow knot (in which the free ends of the shoelace are folded or formed into loops and allowed to hang loose relative to the shoe), the shoelace retainer 500 is moved to the open position (if not already in the open position). As described above, this includes moving the cap 504 of the shoelace retainer 500 relative to the body 506, so that wings 532 of the cap 504 are moved away from the arms 508 of the base 502 (e.g., about ninety degrees, etc.). Portions of the shoelace defining the bows as well as portions of the shoelace associated with the free ends are then each positioned in the shoelace retainer 500 adjacent the plateaus 510 of the arms 508 (such that the shoelace portions extend generally across the plateaus 510 between the base 502 of the body 506 and the corresponding vertically extending end portions of the arms 508). Finally, the shoelace retainer 500 is moved from the open position to the closed position to secure the shoelace in the shoelace retainer 500 (i.e., in receptacles defined by the plateaus 510 of the body's arms 508 and the wings 532 of the cap 504, whereby the wings 532 of the cap 504 move generally over the plateaus 510). In this fashion, the cap 504 and the body 506 again generally define means (e.g., the receptacles defined by the plateaus 510 of the body's arms 508 and the wings 532 of the cap 504, etc.) for securing portions of the shoelace, when tied, in the shoelace retainer 500. While in the illustrated embodiment, the base 502 includes two legs 540 for use in coupling the shoelace retainer 500 to a shoe, it should be appreciated that the base 502 may include other numbers of legs within the scope of the present disclosure. For example, in one alternative embodiment, the base 502 of the shoelace retainer 500 may include a single leg configured to clip under a shoelace already threaded to a shoe to thereby couple the shoelace retainer 500 to the shoe.

Figure 89:
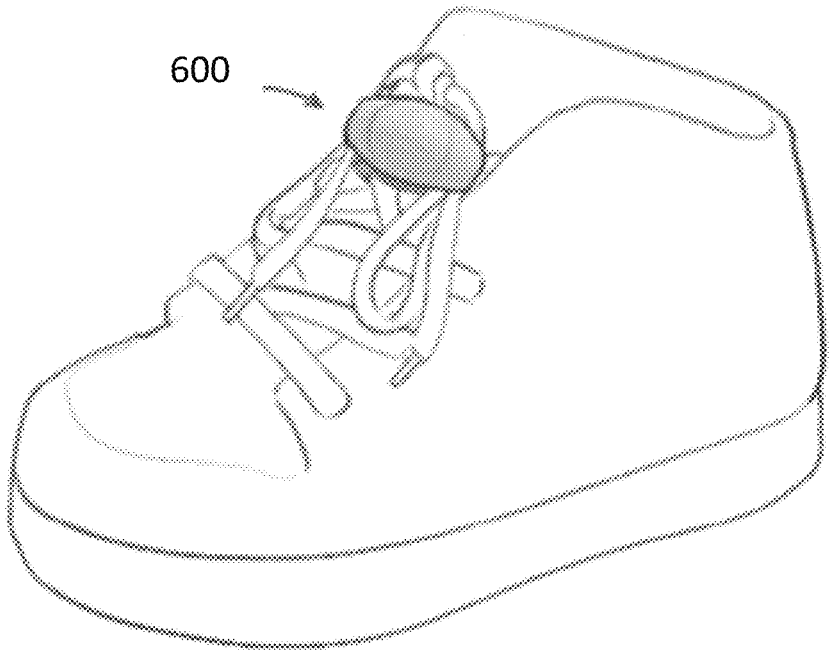
FIG. 89 is a perspective view of a shoe with the shoelace retainer of FIG. 80 shown coupled thereto.

FIGS. 80-89 illustrate still another example embodiment of a shoelace retainer 600 for use with a shoe and including one or more aspects of the present disclosure. Again, the shoelace retainer 600 of this embodiment is configured (e.g., sized, shaped, constructed, etc.) to couple to a shoe and then retain free ends of a shoelace threaded to the shoe (e.g., where the shoelace is already threaded to the shoe via eyelets of the shoe, etc.) to help inhibit the free ends from untying (e.g., to help inhibit a knot formed by the free ends of the shoelace from coming undone, etc.) (FIG. 89).

As shown in FIGS. 80-86, the shoelace retainer 600 is substantially the same as the shoelace retainer 500 described above with reference to FIGS. 73-79, and operates in substantially the same manner (e.g., may be installed to a shoe and used therewith in the same manner, etc.). For example, the shoelace retainer 600 includes a base 602 and a cap 604 coupled to the base 602. And, the base 602 includes a body 606 and arms 608 extending away from the body 606. In addition, the base 602 of the shoelace retainer 600 includes first and second legs 640, and a spacing 642 defined between end portions of the legs 640, for use in coupling the shoelace retainer 600 to a shoe.

Figure 84:
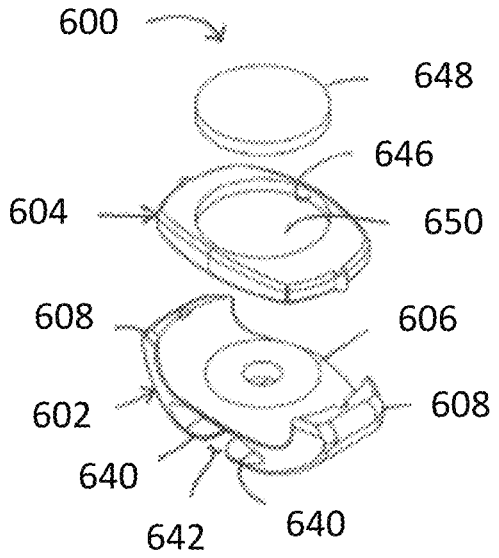
FIG. 84 is an exploded perspective view of the shoelace retainer of FIG. 80.
Figure 85:
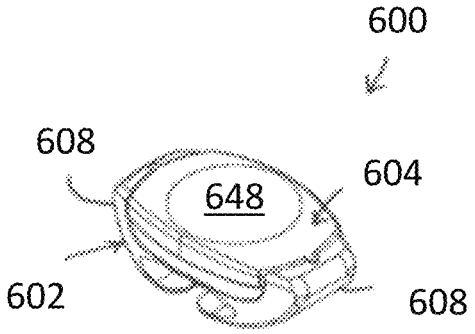
FIGS. 85 and 86 are perspective views of the shoelace retainer of FIG. 80 illustrating movement of the cap of the shoelace retainer relative to the base.
Figure 86:
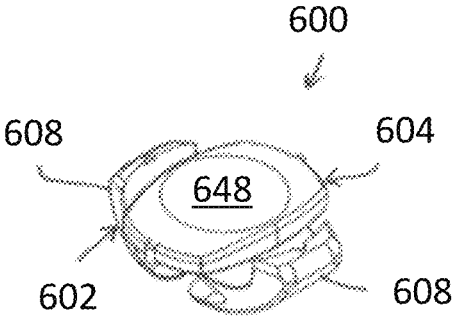
Figure 87:
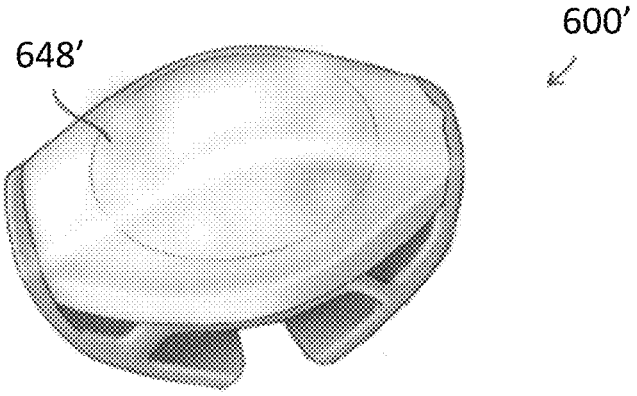
FIG. 87 is a perspective view of a first variation of the shoelace retainer of FIG. 80.
Figure 88:
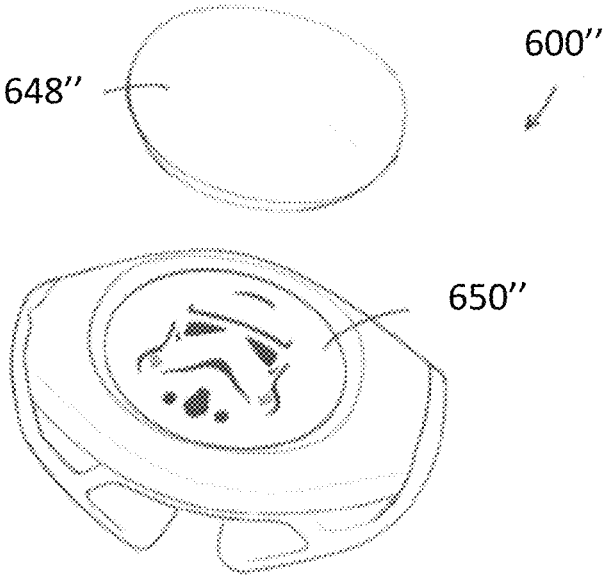
FIG. 88 is a perspective view of a second variation of the shoelace retainer of FIG. 80.

In this embodiment, however, the cap 604 of the shoelace retainer 600 includes an opening 646 and an insert 648 selectively positionable in the opening 646 (FIG. 84). When the insert 648 is positioned in the opening 646, an upper surface of the insert 648 is generally aligned with (e.g., is generally flush with, etc.) an upper surface of the cap 604. And, when the insert 648 is removed from the opening 646, an interior surface 650 of the opening 646 is exposed. In connection therewith, the interior surface 650 of the opening 646 may include one or more illumination features (e.g., light sources (e.g. light emitting diodes associated with a suitable power source such as a battery, etc.; etc.), whereby the insert 648 may be somewhat translucent to allow light to be emitted through the insert; etc.) such as illustrated in the shoelace retainer 600' of FIG. 87 (which includes an insert 648' having an illumination feature), one or more images such as illustrated in the shoelace retainer 600" of FIG. 88 (which includes an image on interior surface 650", generally below insert 648"), combinations thereof, etc. In addition, in other embodiments, the base 602 of the shoelace retainer 600 may alternatively, or additionally, include one or more illumination features.

While in the illustrated embodiment, the insert 648 and the opening 646 of the shoelace retainer 600 define a generally circular shape, it should be appreciated that the insert 648 and/or the opening 646 may have other shapes within the scope of the present disclosure (e.g., oval shapes, square shapes, rectangular shapes, star shapes, other shapes, etc.).

Figure 90:
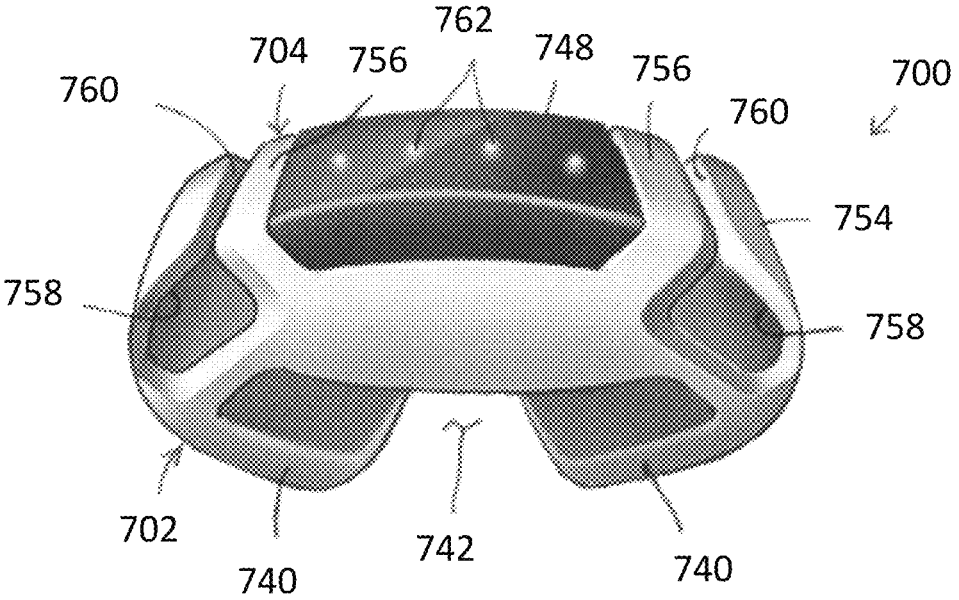
FIG. 90 is a perspective view of a further example embodiment of a shoelace retainer including one or more aspects of the present disclosure.
Figure 91:
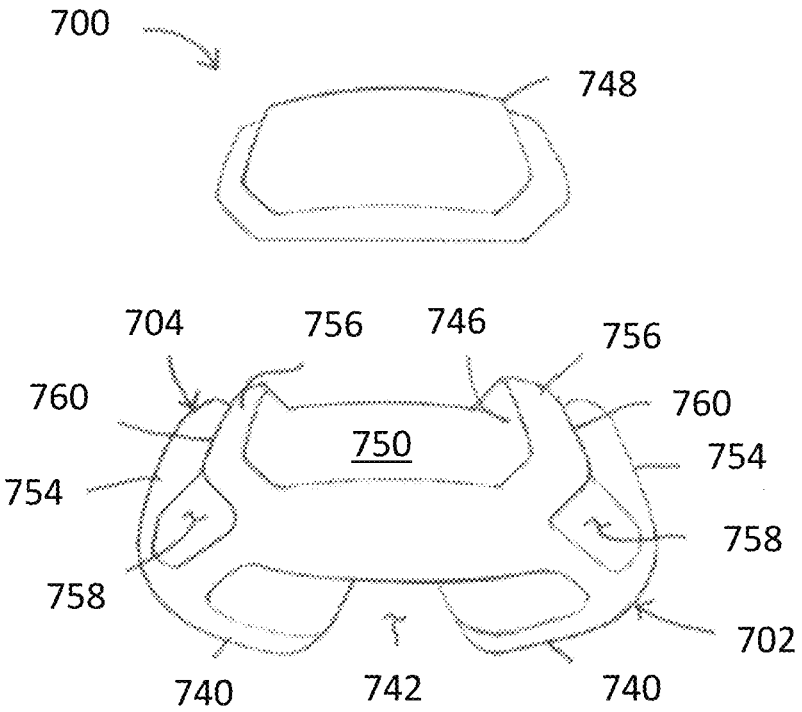
FIG. 91 is an exploded perspective view of the shoelace retainer of FIG. 90.
Figure 92:
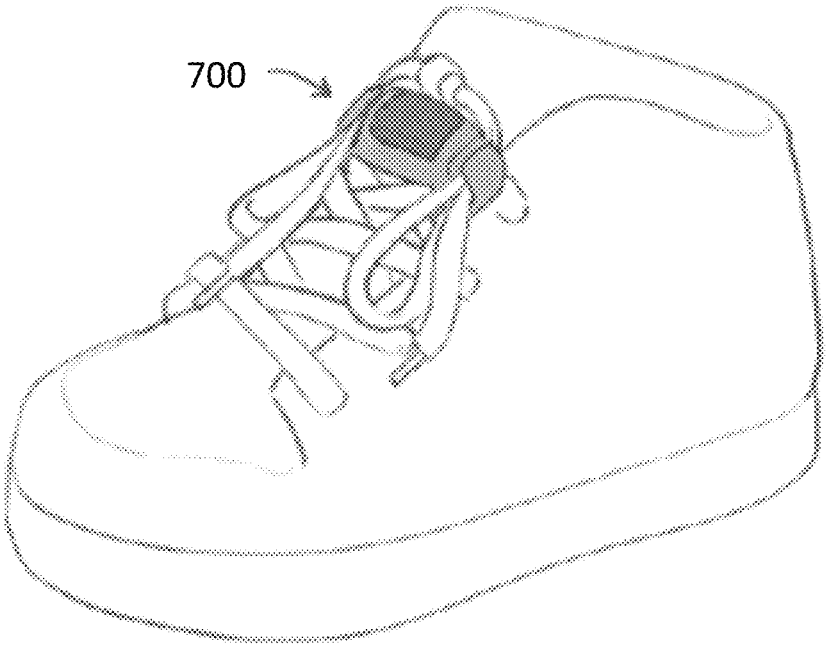
FIG. 92 is a perspective view of a shoe with the shoelace retainer of FIG. 90 shown coupled thereto.

FIGS. 90-92 illustrate a further example embodiment of a shoelace retainer 700 for use with a shoe and including one or more aspects of the present disclosure. Again, the shoelace retainer 700 is configured (e.g., sized, shaped, constructed, etc.) to couple to a shoe and then retain free ends of a shoelace threaded to the shoe (e.g., where the shoelace is already threaded to the shoe via eyelets of the shoe, etc.) to help inhibit the free ends from untying (e.g., to help inhibit a knot formed by the free ends of the shoelace from coming undone, etc.) (FIG. 92).

As shown in FIGS. 90 and 91, the shoelace retainer 700 is similar to the shoelace retainer 600 described above with reference to FIGS. 80-89 (e.g., may be installed to a shoe and used therewith in the same manner, etc.). For example, the shoelace retainer 700 includes a base 702 and a cap 704 coupled to the base 702. And, the base 702 includes first and second legs 740, and a spacing 742 defined between end portions of the legs 740, for use in coupling the shoelace retainer 700 to a shoe (thereby providing the pathways for receiving portions of a shoelace into the shoelace retainer 700 for coupling the shoelace retainer 700 to the shoe, in a similar manner to that described above).

In this embodiment, however, the cap 704 of the shoelace retainer includes two sets of opposing arms 754, 756 that define receptacles 758. As such, the receptacles 758, then, are configured to receive portions of a tied shoelace therein (e.g., end portions of the shoelace, bow portions of the shoelace, etc.), via a spacing 760 defined between the opposing arms 754, 756, to help inhibit the shoelace from inadvertently untying. In connection therewith, end portions of one or both of the opposing arms 754, 756 (of each of the sets) may be resiliently flexible to allow for positioning the desired portions of the shoelace therein, via the spacing 760.

Also in this embodiment, the cap 704 of the shoelace retainer 700 includes an opening 746 and an insert 748 having a generally rectangular shape. What's more, the insert 748 includes a light source 762 (e.g., one or more light emitting diodes associated with a suitable power source, etc.) configured to illuminate the insert 748 as desired (e.g., consistently, selectively via a switch (e.g., via a manual on/off switch, via a pressure sensitive switch such that the light source 762 activates when a shoe to which the shoelace retainer is installed contacts a surface, etc.). And, again, when the insert 748 is positioned in the opening 746, an upper surface of the insert 748 is generally aligned with (e.g., is generally flush with, etc.) an upper surface of the cap 704. Then, when the insert 748 is removed from the opening 746, an interior surface 750 of the opening 746 is exposed. In connection therewith, the interior surface 750 of the opening 746 may further include one or more additional illumination features (e.g., light sources (e.g. light emitting diodes, etc.), etc., whereby the insert 748 may be somewhat translucent to allow light to be emitted through the insert 748; etc.), one or more images, combinations thereof, etc.

It should be appreciated that the example embodiments of shoelace retainers of the present disclosure may have any desired dimensions. For example, and without limitation, shoelace retainers of the present disclosure may have overall height dimensions (e.g., inclusive of the supports and caps, etc.) of between about 0.4 inches and about 0.7 inches (e.g., about 0.6 inches, etc.); overall width dimensions (e.g., in a direction extending from arm to arm of bases of the shoelace retainers, etc.) of between about 1.0 inches and about 2.0 inches (e.g., about 1.2 inches, about 1.3 inches, etc.); overall depth dimensions (e.g., in a direction extending generally from forward portions of the shoelace retainers to rearward portions of the shoelace retainers, etc.) (e.g., inclusive of the supports and caps, etc.) of between 0.8 inches and 1.3 inches (e.g., about 1.0 inches, about 1.1 inches, etc.); caps with radius dimensions of between about 0.2 inches and about 2.0 inches (e.g., about 0.5 inches, about 1.0 inch, etc.); channels with height dimensions of between about 0.05 inches and about 0.3 inches (e.g., about 0.1 inches, about 0.2 inches, etc.). That said, such dimensions are provided for example illustration only and not limitation, as other embodiments may include different dimensions without departing from the scope of the present disclosure.

The foregoing description of the embodiments has been provided for purposes of illustration and description. It is not intended to be exhaustive or to limit the present disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present disclosure, and all such modifications are intended to be included within the scope of the present disclosure. In connection therewith, exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Example embodiments have been provided so that this disclosure will be thorough, and will fully convey the scope to those who are skilled in the art. Numerous specific details are set forth such as examples of specific components, assemblies, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, components, and/or groups thereof, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" and the phrase "at least one of" includes any and all combinations of one or more of the associated listed items.

Although the terms first, second, third, etc. may be used herein to describe various elements, components, seeds, members and/or sections, these elements, components, seeds, members and/or sections should not be limited by these terms. These terms may be only used to distinguish one element, component, seed, member or section from another element, component, seed, member or section. Terms such as "first," "second," and other numerical terms when used herein do not imply a sequence or order unless clearly indicated by the context. Thus, a first element, component, seed, member or section discussed below could be termed a second element, component, seed, member or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A shoelace retainer for use with a shoelace coupled to a shoe, the shoelace retainer comprising:

a base portion defining a channel for receiving a shoelace of a shoe therein to thereby couple the shoelace retainer to the shoe;

a body portion disposed generally above the base portion and defining first and second channels for receiving portions of the shoelace therein, while the shoelace is coupled to the shoe, wherein the channel defined by the base portion extends at least partly under the body portion;

at least one arm extending away from the body portion;

a cap configured to rotate relative to the body portion to a position to selectively cover at least part of the first and second channels defined by the body portion to thereby inhibit movement of the portions of the shoelace out of the first and second channels when received therein, wherein the cap includes a protrusion configured to engage the at least one arm when the cap is rotated to the position to cover the at least part of the first and second channels defined by the body portion and secure the cap in said position; and a mount configured to couple the cap to the body portion, the mount disposed on the body portion and at least partly defining the first and second channels.

2. The shoelace retainer of claim 1, wherein the at least one arm includes first and second arms, the first arm extending at least partly over the first channel of the body portion and the second arm extending at least partly over the second channel of the body portion.

3. The shoelace retainer of claim 2, wherein the first and second arms each include an end portion disposed generally forward of the mount, the end portion of the first arm and the end portion of the second arm defining a spacing there between for receiving the portions of the shoelace into the first and second channels.

4. The shoelace retainer of claim 1, wherein the first and second channels defined by the body portion are disposed generally over the channel defined by the base portion.

5. The shoelace retainer of claim 1, wherein the at least one arm includes first and second arms, the first arm extending at least partly over the first channel of the body portion and the second arm extending at least partly over the second channel of the body portion;

wherein the first and second arms each include an end portion disposed generally forward of the mount, the end portion of the first arm and the end portion of the second arm defining a spacing there between for receiving the portions of the shoelace into the first and second channels; and wherein the cap is configured to rotate relative to the body portion to selectively cover and uncover the spacing between the end portions of the first and second arms.

6. The shoelace retainer of claim 5, wherein the protrusion of the cap is configured to fit within the spacing between the end portions of the first and second arms when the cap is positioned to cover the spacing and the at least part of the first and second channels defined by the body portion.

7. The shoelace retainer of claim 1, wherein the mount includes an opening and wherein the cap includes a boss configured to fit within the opening to thereby rotatably couple the cap to the body portion.

8. The shoelace retainer of claim 7, wherein the boss is disposed on the cap at a location away from a center point of the cap.

9. The shoelace retainer of claim 1, wherein the base portion, the body portion, and the mount are integral.

10. A shoelace retainer for use with a shoelace coupled to a shoe, the shoelace retainer comprising:

a base defining at least one channel for receiving a shoelace of a shoe therein, to thereby couple the shoelace retainer to the shoe when the shoelace is coupled to the shoe;

a body coupled to the base and defining at least one channel for receiving an end portion of the shoelace therein, while the shoelace retainer is coupled to the shoe, wherein the body includes first and second arms; and a cap configured to couple to the body, the cap moveable relative to the body to selectively cover at least part of the at least one channel of the body to thereby inhibit movement of the end portion of the shoelace out of the at least one channel when received therein, wherein the cap includes a protrusion configured to engage the first arm and/or the second arm when the cap is positioned to cover the at least part of the at least one channel of the body, and wherein the protrusion of the cap is configured to further fit within a spacing between end portions of the first and second arms when the cap is positioned to cover the at least part of the at least one channel of the body.

11. The shoelace retainer of claim 10, wherein the first arm and/or the second arm of the body extends at least partly over the at least one channel of the body, to thereby inhibit movement of the end portion of the shoelace out of the at least one channel when received therein.

12. The shoelace retainer of claim 10, wherein the base and the body are integral.

13. A shoelace retainer for use with a shoelace coupled to a shoe, the shoelace retainer comprising:

a base defining a channel for receiving a shoelace of a shoe therein to thereby couple the shoelace retainer to the shoe;

a body disposed generally above the base and defining first and second channels for receiving portions of the shoelace therein, while the shoelace is coupled to the shoe, the body including first and second arms, the first arm extending at least partly over the first channel of the body and the second arm extending at least partly over the second channel of the body;

a mount disposed on the body and at least partly defining the first and second channels; and a cap configured to moveably couple to the mount;

wherein the first and second arms of the body each include an end portion disposed generally forward of the mount, the end portion of the first arm and the end portion of the second arm defining a spacing there between for receiving the portions of the shoelace into the first and second channels; and wherein the cap is configured to rotate relative to the body to selectively cover and uncover the spacing between the end portions of the first and second arms, the cap including a protrusion configured to fit within the spacing between the end portions of the first and second arms when the cap is positioned to cover the spacing.

14. A shoelace retainer for use with a shoelace coupled to a shoe, the shoelace retainer comprising:

a base defining at least one channel for receiving a shoelace of a shoe therein, to thereby couple the shoelace retainer to the shoe when the shoelace is coupled to the shoe;

a body coupled to the base and defining at least one channel for receiving an end portion of the shoelace therein, while the shoelace retainer is coupled to the shoe, wherein the body includes first and second arms; and a cap configured to couple to the body, the cap rotatable relative to the body between an open position for receiving the end portion of the shoelace into a spacing between the first and second arms and into the at least one channel defined by the body, and a closed position for covering the spacing and retaining the end portion of the shoelace in the at least one channel defined by the body;

wherein the cap is generally parallel to the base in the open position and in the closed position, and wherein the cap remains generally parallel to the base during movement of the cap between the open position and the closed position.

* * * * *